US011006756B2

(12) United States Patent
Neu et al.

(10) Patent No.: US 11,006,756 B2
(45) Date of Patent: May 18, 2021

(54) HEAD SUPPORT DEVICE WITH CENTRAL AND SIDE SUPPORTS

(71) Applicant: Cabeau, Inc., Woodland Hills, CA (US)

(72) Inventors: Thorben Neu, Los Angeles, CA (US); Christopher Lee Collins, Long Beach, CA (US); Avery Erik Holleman, Long Beach, CA (US); John Edward Wilkening, Capitola, CA (US); Gideon Blumstein, Los Angeles, CA (US)

(73) Assignee: Cabeau, Inc., Woodland Hills, CA (US)

( * ) Notice: Subject to any disclaimer, the term of this patent is extended or adjusted under 35 U.S.C. 154(b) by 109 days.

(21) Appl. No.: 16/279,293

(22) Filed: Feb. 19, 2019

(65) Prior Publication Data

US 2019/0254435 A1 Aug. 22, 2019

Related U.S. Application Data

(60) Provisional application No. 62/631,613, filed on Feb. 16, 2018.

(51) Int. Cl.

| | |
|---|---|
| ***A47C 7/38*** | (2006.01) |
| ***A47G 9/10*** | (2006.01) |
| ***A47C 20/02*** | (2006.01) |

(52) U.S. Cl.

CPC ..... *A47C 7/383* (2013.01); *A47G 9/1081* (2013.01); *A47C 20/02* (2013.01); *A47G 2009/1018* (2013.01)

(58) Field of Classification Search

CPC ..... A47C 7/383; A47C 20/02; A47G 9/1081; A47G 2009/1018; A61F 5/055

USPC ..... 5/636, 622; 297/392, 393

See application file for complete search history.

(56) References Cited

U.S. PATENT DOCUMENTS

| | | | | | |
|---|---|---|---|---|---|
| 4,398,621 | A * | 8/1983 | Baker | A62B 1/20 | 182/48 |
| 4,565,408 | A * | 1/1986 | Palley | A47C 7/383 | 297/392 |
| 4,580,659 | A * | 4/1986 | Baker | A62B 1/20 | 182/2.11 |
| 4,881,529 | A * | 11/1989 | Santos | A41D 13/0512 | 2/468 |
| 5,060,661 | A * | 10/1991 | Howard | A61F 5/05816 | 128/845 |
| 5,402,535 | A * | 4/1995 | Green | A41D 13/018 | 128/DIG. 23 |
| 5,507,718 | A * | 4/1996 | Kabat | A61F 5/055 | 602/18 |

(Continued)

OTHER PUBLICATIONS

International Search Report and Written Opinion received for PCT Patent Application No. PCT/US2019/018548, dated Apr. 30, 2019, 15 pages.

*Primary Examiner* — Nicholas F Polito
*Assistant Examiner* — Luke Hall
(74) *Attorney, Agent, or Firm* — DLA Piper LLP (US)

(57) ABSTRACT

Head support devices including two side supports with a central support suspended therebetween. In some embodiments, the central support may be configured to hold and provide support to a user's chin. A connector such as a strap may be configured to connect the side supports to one another, with the connector configured to wrap around the rear of a user's head or neck.

17 Claims, 28 Drawing Sheets

(56) References Cited

U.S. PATENT DOCUMENTS 5,611,601 A * 3/1997 Cowgur ..... A47C 16/00 297/393
5,769,708 A * 6/1998 Paschke ..... F24F 13/06 454/306
5,778,469 A * 7/1998 Festa ..... A47C 7/383 297/393
5,946,735 A * 9/1999 Bayes ..... A42B 3/08 2/421
6,042,185 A * 3/2000 Cowgur ..... A47C 7/383 297/393
6,216,298 B1 * 4/2001 Oliveira ..... A47C 7/383 297/393
6,219,865 B1 * 4/2001 Stokesbary ..... A47G 9/10 297/392
6,231,535 B1 * 5/2001 Mainiero ..... A47C 7/383 5/636
6,266,832 B1 * 7/2001 Ezell ..... A47G 9/10 297/219.12
6,289,538 B1 * 9/2001 Fidge ..... A47C 7/383 297/393
6,859,939 B1 * 3/2005 Osburn, Sr. ..... A41D 13/018 128/869
6,859,965 B1 * 3/2005 Gourd ..... A47C 7/383 297/393
6,957,462 B1 * 10/2005 Wilcox ..... A47C 7/383 297/393
7,055,908 B1 * 6/2006 Williams ..... A47C 7/383 297/392
7,070,573 B2 * 7/2006 Axelsson ..... A61F 5/055 128/845
7,306,573 B2 * 12/2007 Bonutti ..... A61F 5/055 602/18
7,406,732 B2 * 8/2008 Ramaiah ..... A47G 9/10 5/622
7,926,839 B1 * 4/2011 Mothaffar ..... B60R 21/18 280/730.1
7,958,582 B1 * 6/2011 Scamardo ..... B60N 2/885 5/632
8,100,846 B1 * 1/2012 LaMonica ..... A61F 5/048 602/32
8,402,568 B2 * 3/2013 Alstin ..... A41D 13/0512 2/413
8,566,986 B1 * 10/2013 Chu ..... A47G 9/1054 5/636
8,726,421 B2 * 5/2014 Alvarez ..... A41D 13/0512 2/207
8,763,180 B1 * 7/2014 Tsai ..... A47G 9/1027 5/640
8,777,523 B2 * 7/2014 Stephens ..... E02B 3/127 405/302.6
8,783,776 B1 * 7/2014 Perkins ..... A47C 7/383 297/392
8,931,127 B1 * 1/2015 Moses ..... A47C 27/15 5/652
8,984,688 B1 * 3/2015 Ibrahim ..... A47G 9/10 5/632
9,635,962 B2 5/2017 Sternlight et al.
10,001,346 B2 * 6/2018 Augustine ..... A41D 13/018
10,173,629 B2 * 1/2019 Barbat ..... B60R 21/235
10,390,580 B2 * 8/2019 Olsson ..... A42B 3/0486
2001/0040401 A1 * 11/2001 Lin ..... B60N 2/885 297/397
2001/0054837 A1 * 12/2001 O'Connor ..... B60N 2/868 297/397
2002/0185573 A1 * 12/2002 Bisch ..... B60N 2/882 248/118
2003/0037376 A1 * 2/2003 Zell ..... A47C 7/383 5/636
2003/0038520 A1 * 2/2003 Marbutt ..... B60N 2/2881 297/392
2003/0159216 A1 * 8/2003 Tomcany ..... A61F 5/3707 5/628
2004/0064893 A1 * 4/2004 Sharp ..... A47C 16/00 5/655.3
2004/0200004 A1 * 10/2004 Matthews Brown .. A47D 13/08 5/655
2005/0223492 A1 * 10/2005 Littlehorn ..... A47C 20/021 5/636
2005/0241068 A1 * 11/2005 Tomcany ..... A61G 1/01 5/622
2005/0278853 A1 * 12/2005 Littlehorn ..... A47C 20/023 5/636
2006/0053556 A1 * 3/2006 Piontek ..... A61F 5/3707 5/637
2006/0061186 A1 * 3/2006 Funke, III ..... A47C 7/383 297/393
2006/0267392 A1 * 11/2006 Charnitski ..... A47C 7/383 297/393
2007/0052274 A1 * 3/2007 Morphew ..... B60N 2/2839 297/392
2007/0209115 A1 * 9/2007 Carroll ..... A47C 7/383 5/636
2007/0256692 A1 * 11/2007 Pearson ..... A47C 7/383 128/845
2008/0034503 A1 * 2/2008 Hightower ..... A47G 9/10 5/636
2008/0034504 A1 * 2/2008 Schmidt ..... A47C 7/383 5/644
2008/0034505 A1 * 2/2008 Thomas ..... A47D 15/008 5/655
2008/0216244 A1 * 9/2008 Minton ..... A47G 9/10 5/640
2008/0229498 A1 * 9/2008 Grosso ..... A47C 7/383 5/244
2009/0133193 A1 * 5/2009 Weise ..... A47G 9/10 5/640
2009/0206646 A1 * 8/2009 Mittelstadt ..... A47C 7/383 297/397
2009/0283557 A1 * 11/2009 Maginness ..... A47C 7/383 224/153
2009/0309406 A1 * 12/2009 Campa ..... B60N 2/882 297/397
2009/0313761 A1 * 12/2009 North ..... A47C 20/02 5/632
2010/0036301 A1 * 2/2010 Baldauf ..... A61F 5/055 602/14
2010/0175194 A1 * 7/2010 Mastrosimone-Gese ..... A47D 13/083 5/639
2010/0319131 A1 * 12/2010 North ..... A47C 20/02 5/633
2011/0017793 A1 * 1/2011 Mellion ..... A45F 3/02 224/610
2011/0271421 A1 * 11/2011 Vahey ..... A42B 1/061 2/173
2012/0011655 A1 * 1/2012 Rojas ..... A47C 7/383 5/636
2012/0047656 A1 * 3/2012 Benton ..... A47C 7/383 5/640
2012/0124747 A1 * 5/2012 Soto ..... A61G 13/101 5/622
2012/0144590 A1 * 6/2012 Sharp ..... A47C 7/383 5/639
2013/0061856 A1 * 3/2013 Khademi ..... A61F 13/128 128/845
2013/0119716 A1 * 5/2013 Stronconi ..... B60N 2/882 297/180.1
2013/0226055 A1 * 8/2013 Akpotaire ..... A61F 5/055 602/18
2013/0232693 A1 * 9/2013 Myers ..... A47C 7/383 5/636
2013/0254998 A1 * 10/2013 Walker ..... A47G 9/1081 5/637
2013/0305432 A1 * 11/2013 Thomson ..... A42B 1/006 2/181
2014/0000036 A1 * 1/2014 Cohen ..... A47C 27/081 5/639

(56) References Cited

U.S. PATENT DOCUMENTS

2014/0007351 A1* 1/2014 Cohen ..... A47G 9/0253 5/639
2014/0101823 A1* 4/2014 Thomson ..... A42B 1/24 2/209.13
2014/0317849 A1* 10/2014 Legrand ..... A47G 9/1045 5/636
2014/0331397 A1* 11/2014 Kasahara ..... A41D 13/0512 2/468
2015/0013071 A1* 1/2015 Freund ..... A47C 7/383 5/639
2015/0059098 A1* 3/2015 Jung ..... D05B 93/00 5/636
2015/0091357 A1* 4/2015 Register ..... A47C 7/546 297/411.23
2015/0107025 A1* 4/2015 Dauphin ..... A47C 16/00 5/638
2015/0121627 A1* 5/2015 O'Donnell ..... A47G 9/083 5/639
2015/0150391 A1* 6/2015 Hsu ..... A47C 7/383 5/636
2015/0157134 A1* 6/2015 Ko ..... A47G 9/1081 5/655.9
2015/0230635 A1* 8/2015 Abrams ..... A47C 7/383 5/636
2015/0257555 A1* 9/2015 Wong ..... A47G 9/10 5/636
2015/0313293 A1* 11/2015 Hunt ..... A41D 13/001 2/456
2015/0320244 A1* 11/2015 Li ..... A47C 7/383 5/482
2015/0320626 A1* 11/2015 Lander ..... A61G 13/121 5/640
2015/0352988 A1* 12/2015 Knapp ..... B60N 2/245 297/393
2016/0007756 A1* 1/2016 Hauer ..... A47C 7/383 5/644
2016/0007777 A1* 1/2016 Gang ..... B60N 2/882 5/639
2016/0029821 A1* 2/2016 Atkinson ..... A47G 9/1081 5/636
2016/0045008 A1* 2/2016 Cooper ..... A45F 3/14 224/577
2016/0081459 A1* 3/2016 Amick ..... A47C 7/383 4/523
2016/0120253 A1* 5/2016 Schenk ..... A47C 7/383 2/173
2016/0120725 A1* 5/2016 Slattery ..... A61G 13/0018 5/622
2016/0297336 A1* 10/2016 Suomi ..... B60R 22/30
2017/0000273 A1* 1/2017 Mitchell ..... A47C 7/383
2017/0020313 A1* 1/2017 Sanh ..... A47G 9/1045
2017/0042332 A1* 2/2017 Atkinson ..... A47C 7/383
2017/0050547 A1* 2/2017 Dunham ..... A47C 7/383
2017/0065108 A1* 3/2017 Thorn ..... A47C 7/383
2017/0071349 A1 3/2017 Wong
2017/0086607 A1 3/2017 Wong et al.
2017/0232874 A1* 8/2017 Blankenship ..... B64D 11/062 297/392

* cited by examiner

HEAD SUPPORT DEVICE WITH CENTRAL AND SIDE SUPPORTS

CROSS REFERENCE TO RELATED APPLICATIONS

This application claims the benefit of U.S. Provisional Application No. 62/631,613 filed on Feb. 16, 2018, the contents of which is hereby, fully incorporated by reference in its entirety.

This application also relates to commonly owned U.S. Pat. No. 9,635,962 to Sternlight et al., commonly owned US Patent Application Publication Nos. 2017/0071349 to Wong et al, and 2017/0086607 to Wong et al, the contents of which are hereby, fully incorporated by reference herein by their entirety.

TECHNICAL FIELD

This disclosure generally relates to head support devices, and more particularly to head support devices used while travelling for user comfort, and even more particularly to head support devices designed to support a user's head when in a forward position.

BACKGROUND

Travel pillows are used by airplane travelers and others in order to provide support for a user's neck and head. While conventional prior art travel pillows provide support for a user's head, they often do not provide support for a user's head in a forward-leaning position, and often look unsightly. Further, certain prior art devices that do provide head support in a forward-leaning position are often not well-ventilated around a user's neck, such as that described and shown in U.S. Pat. App. Pub. No. 2013/0232693 to Myers. Additionally, conventional prior art travel pillows and the like can be bulky and unwieldy when not in use around a user's neck.

SUMMARY

The present disclosure is generally directed to head support devices for supporting a user's head, such as while travelling on an airplane, train, or car.

In some embodiments, a head support device according to the present disclosure includes left and right side supports, with a central support between the left and right side supports. The central support may be configured to support a user's chin, and may be breathable so as to prevent or lessen a build-up of heat and moisture. A connector between the left and right side supports may be configured to wrap around the rear of the user's head or neck.

The head support device may include a left side support having a left shell and said right side support having a right shell. The connector may be a strap. The operable length of the strap is adjustable. The strap includes two portions that are detachable from one another. The central support is breathable and may include a mesh material. The central support may include a screen material. The central support connects the left side support to the right side support. The central support may be suspended between an inner surface of said left side support and an inner surface of said right side support. Each of said left side support and said right side support may be shaped to define an aperture therethrough such that each of said left and right side supports has an outer perimeter and an inner perimeter. In some embodiments, the cross-section of said central support substantially matches the inner perimeters of the left and right side supports. The central support may be collapsible, flexible, and/or open on both ends. The central support may be a sleeve. Each of the left side support and the right side support includes a frame portion and a pad portion, each of the frame portions made of a first material and each of the pad portions made of a second material, the first material being more rigid than said second material. The first material is plastic. The second material may be memory foam. Each of the frame portions and pad portions may be cup-shaped. Each of the left side support and the right side support may have a concave shape from the outside thereof. Each of the left side support and the right side support may have a vertical cross-section that is substantially outwardly C-shaped. In some embodiments, each of the left side support and the right side support is cup-shaped. In some embodiments, each of the left side support and the right side support has a trapezoidal side cross-section. In some embodiments, each of the left side support and the right side support has a trapezoidal front cross-section. In some embodiments, the central support includes left and right collars for attachment to the left side support and the right side support, respectively. The head support device may include left and right retaining members for securing the central support to said left side support and said right side support, respectively. The head support device may include left and right retaining members, a central support having left and right collars for attachment to said left side support and said right side support, respectively; and where the left retaining member, the left collar, and the left side support interact to secure the central support to the left side support, and the right retaining member, the right collar, and the right side support interact to secure the central support to the right side support.

In some embodiments, a head support device includes a central support having a concave upper surface configured to receive at least a portion of a user's chin, the central support having a first end spaced apart from the second end, the first end and the second end each terminating in a side support, and a connector element having a first end configured to attach to the side support at the first end of the central support, and a second end configured to attach to the side support at the second end of the central support.

In some embodiments, the central support includes a hollow interior. The side support may include a hollow interior configured to align with the hollow interior of the central support. Each side support may include a frame portion and a pad portion. The connector element includes a strap. The strap may include at least one of an adjustable operable length and one or more portions detachable from one another. The central support may be breathable. The central support may include at least one of mesh and screen. The central support is at least one of flexible and collapsible. The frame portion includes rigid material. In some embodiments, the frame portion includes plastic. In some embodiments, the pad portion includes memory foam material. In some embodiments, each side support includes a trapezoidal side cross-section. In some embodiments, each side support has a vertical cross-section that is substantially outwardly C-shaped. In some embodiments each sides support includes a concave shape from the outside thereof. In some embodiments, each side support includes an inner perimeter and an outer perimeter, having a sloped surface there between. In some embodiments at least one of a bottom surface of the central support, and the side supports is configured to engage with at least a portion of at least one of a user's chest, neck, shoulder and collarbone. In some embodiments the first end and the second end of the central support each comprises a retaining member configured to secure the central support to the respective side support. In some embodiments the first end and the second end of the central support teach comprises a collar for attachment to the side support. In some embodiments, the respective ends of the connector element attaches to a frame portion of the respective side supports.

BRIEF DESCRIPTION OF THE DRAWINGS

The features and advantages of the disclosure would be apparent to those skilled in the art from the following detailed description, taken together with the accompanying drawings, in which.

DETAILED DESCRIPTION OF THE INVENTION

Figure 1:
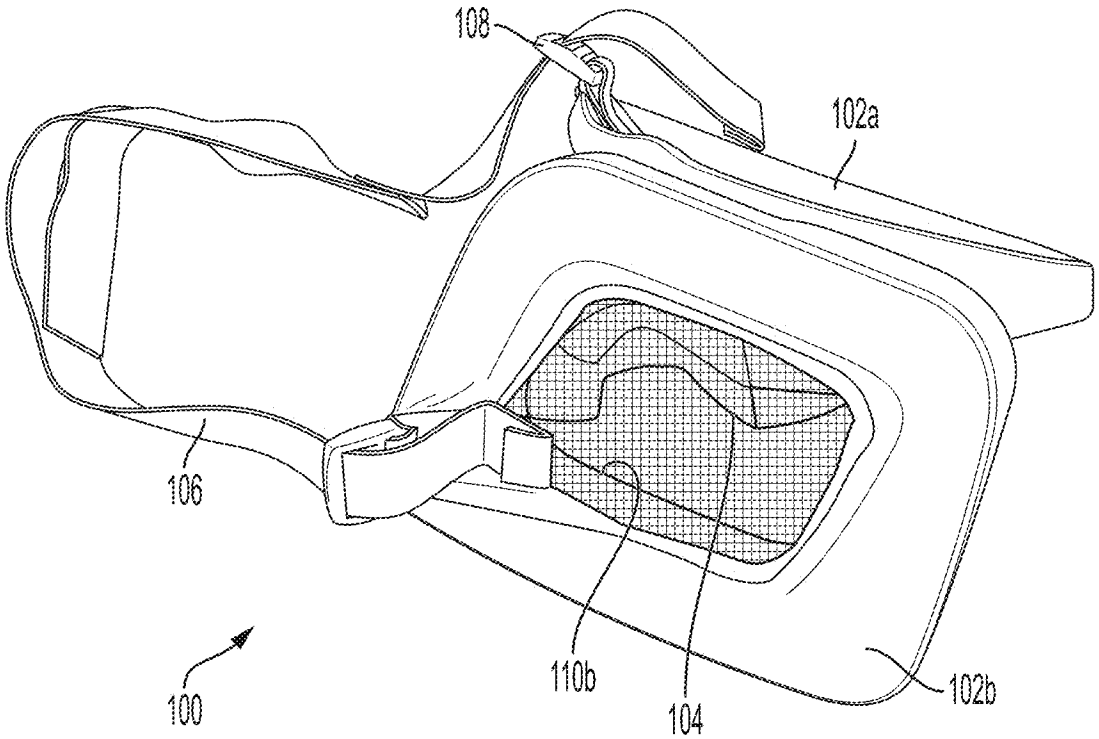
FIG. 1 is a top perspective view of a head support device according to aspects of the present disclosure.

The present disclosure describes head support devices that can be used in place of a traditional travel pillow. The head support devices generally include two side supports with a central support suspended therebetween. In some embodiments, the central support may be configured to hold and provide support to a user's chin. A connector such as a strap may be configured to connect the side supports to one another, with the connector configured to wrap around the rear of a user's head or neck. The connector can be of adjustable operable length, so as to enable tightening of the head support device to the user's chest, neck, shoulder, and jaw areas. Each side support may generally include a frame portion for giving each side support its general structure, shape, and strength, as well as a pad portion that abuts the user for comfort. The central support can be attached through apertures of the side supports, though other attachment means are possible. In some embodiments, the central support may be breathable so as to prevent or lessen the accumulation of heat and moisture in a user's neck and jaw area, a common problem with prior art travel pillows. The central support can be made of a mesh or screen material to achieve this purpose. Additionally, the central support can be collapsible, so as to enable the compacting of the head support device for easy travel or storage when not in use.

The present disclosure is described herein with reference to certain embodiments, but it is understood that the disclosure may be embodied in many different forms and should not be construed as limited to the embodiments set forth herein. The devices and elements herein may have different shapes and sizes beyond those shown. It is also understood that when a feature or element, such as a layer, region, case, cover, frame, or otherwise may be referred to as being "on" another element, it can be directly on the other element or intervening elements may also be present. Furthermore, relative terms such as "inner," "outer," "upper," "above," "lower," "beneath," and "below," and similar terms, may be used herein to describe a relationship of one element to another. It is understood that these terms are intended to encompass different orientations of the device in addition to the orientation depicted in the figures.

Although the terms first, second, etc. may be used herein to describe various, e.g., elements, components, regions, layers and/or sections, these elements, components, regions, layers and/or sections should not be limited by these terms. These terms are only used to distinguish one element, component, region, layer, or section from another element, component, region, layer, or section. Thus, a first element, component, region, layer, or section discussed below could be termed a second element, component, region, layer, or section without departing from the teachings of the present disclosure.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. When the word "each" is used to refer to an element, it does not necessarily imply a plurality of the elements, but can also mean a singular element.

Figure 2:
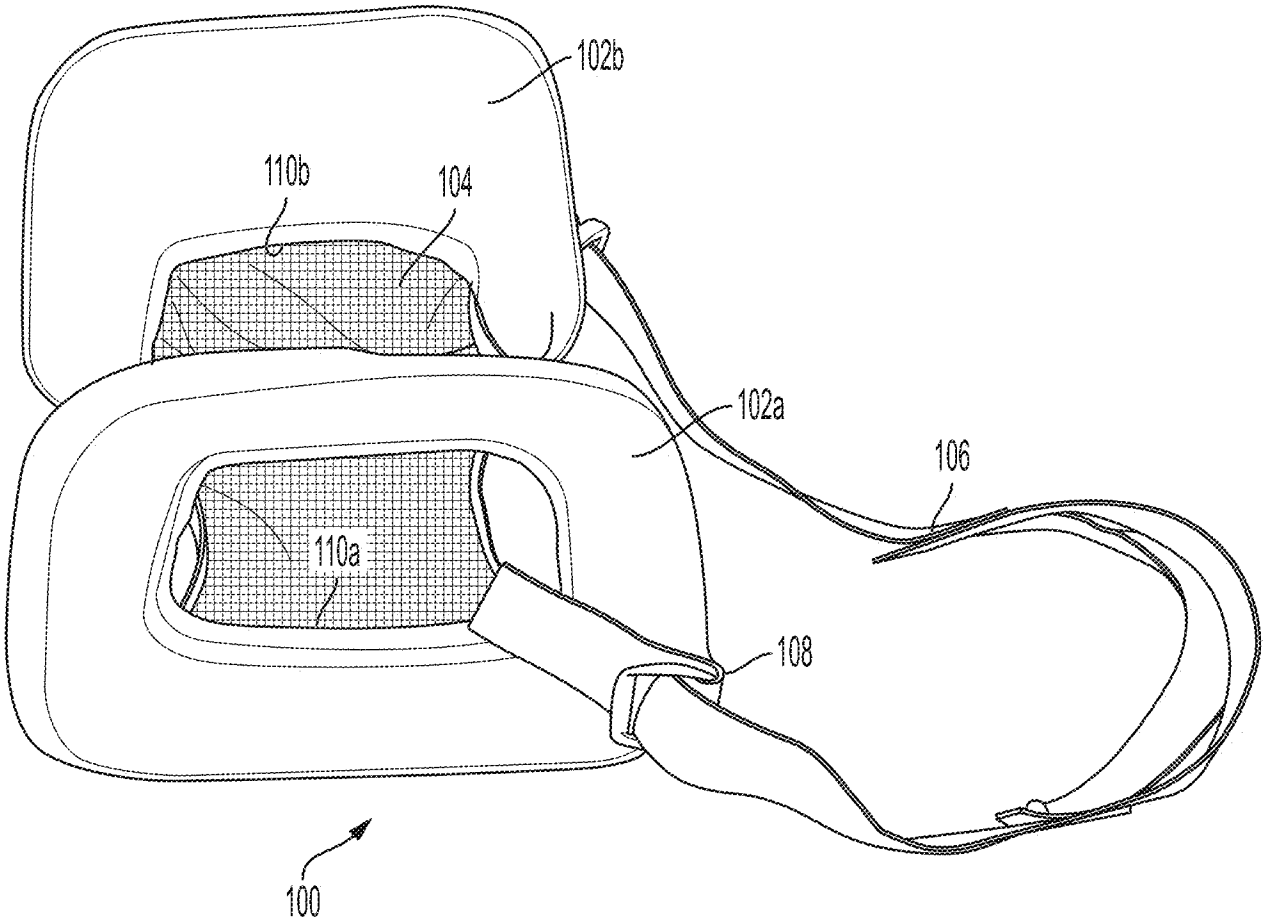
FIG. 2 is a side perspective view of the head support device shown in FIG. 1.
Figure 3:
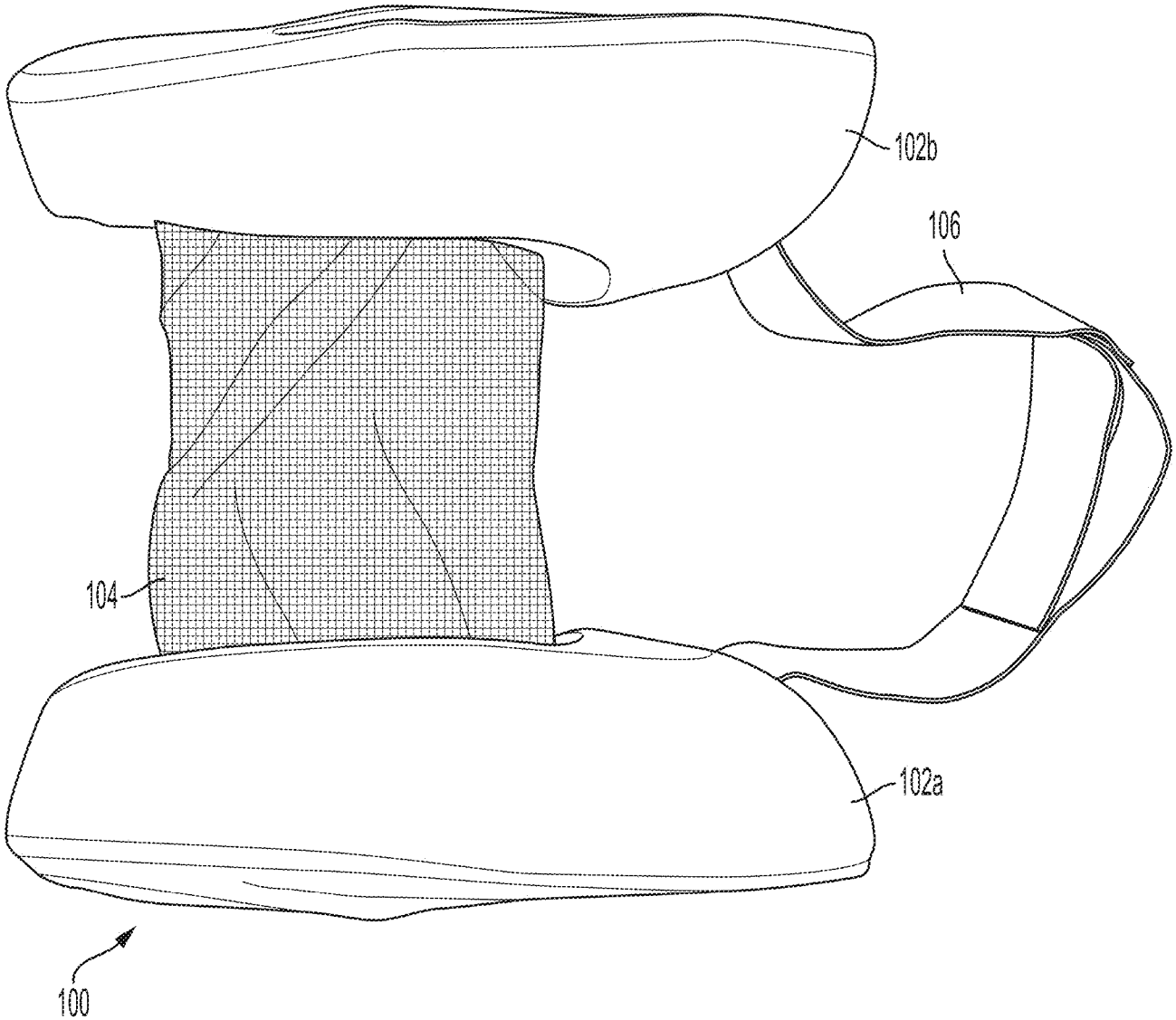
FIG. 3 is a top view of the head support device shown in FIG. 1.
Figure 4:
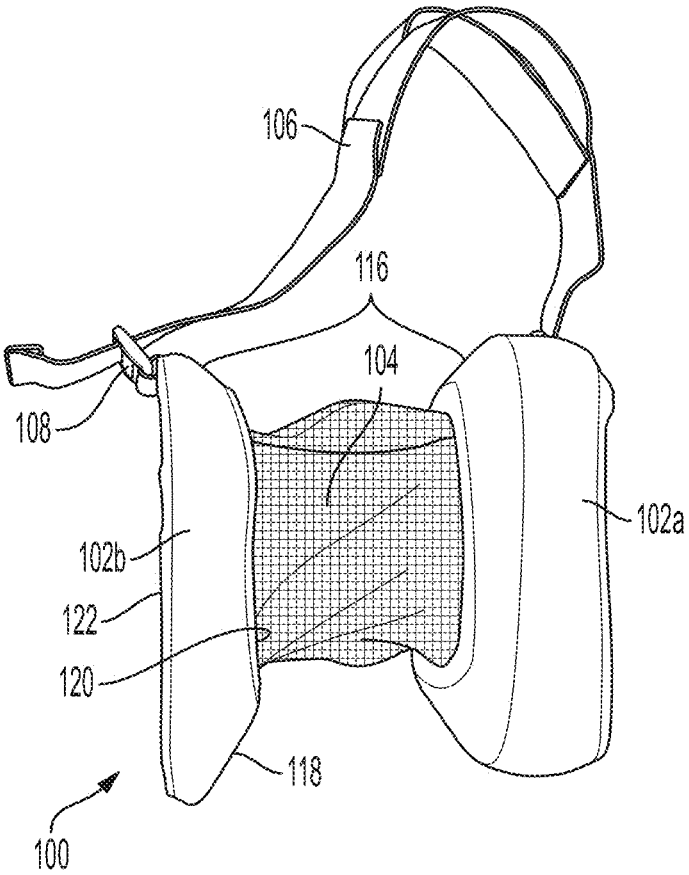
FIG. 4 is a top view of the head support device shown in FIG. 1.
Figure 5:
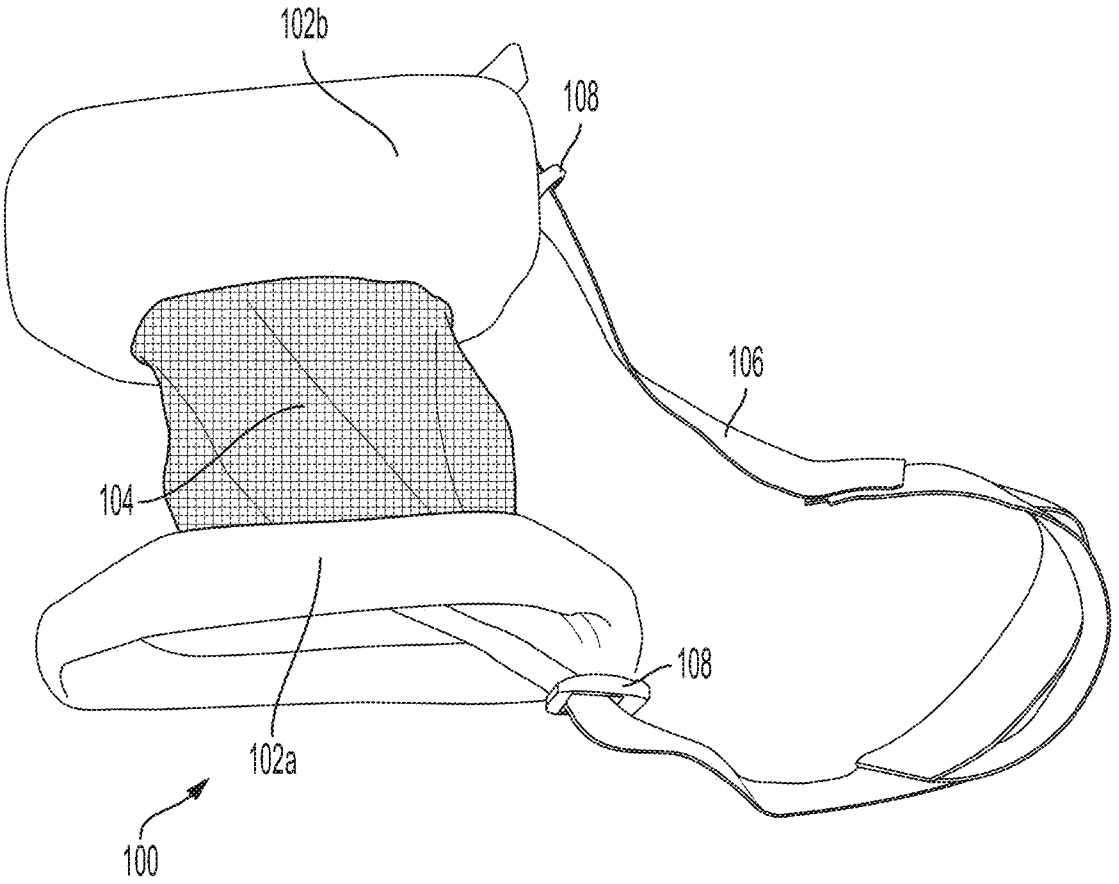
FIG. 5 is a top view of the head support device shown in FIG. 1.
Figure 6:
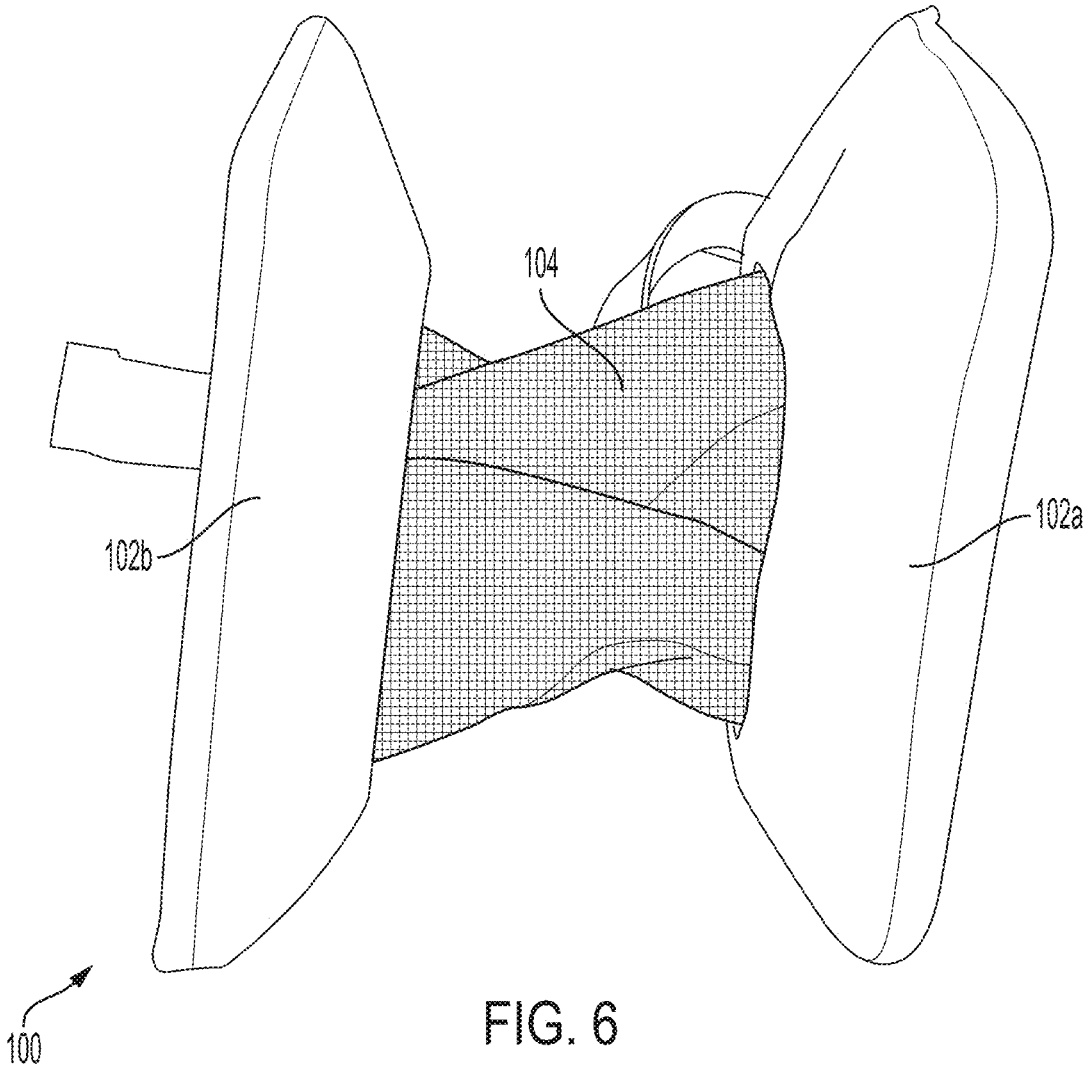
FIG. 6 is a front view of the head support device shown in FIG. 1.
Figure 7:
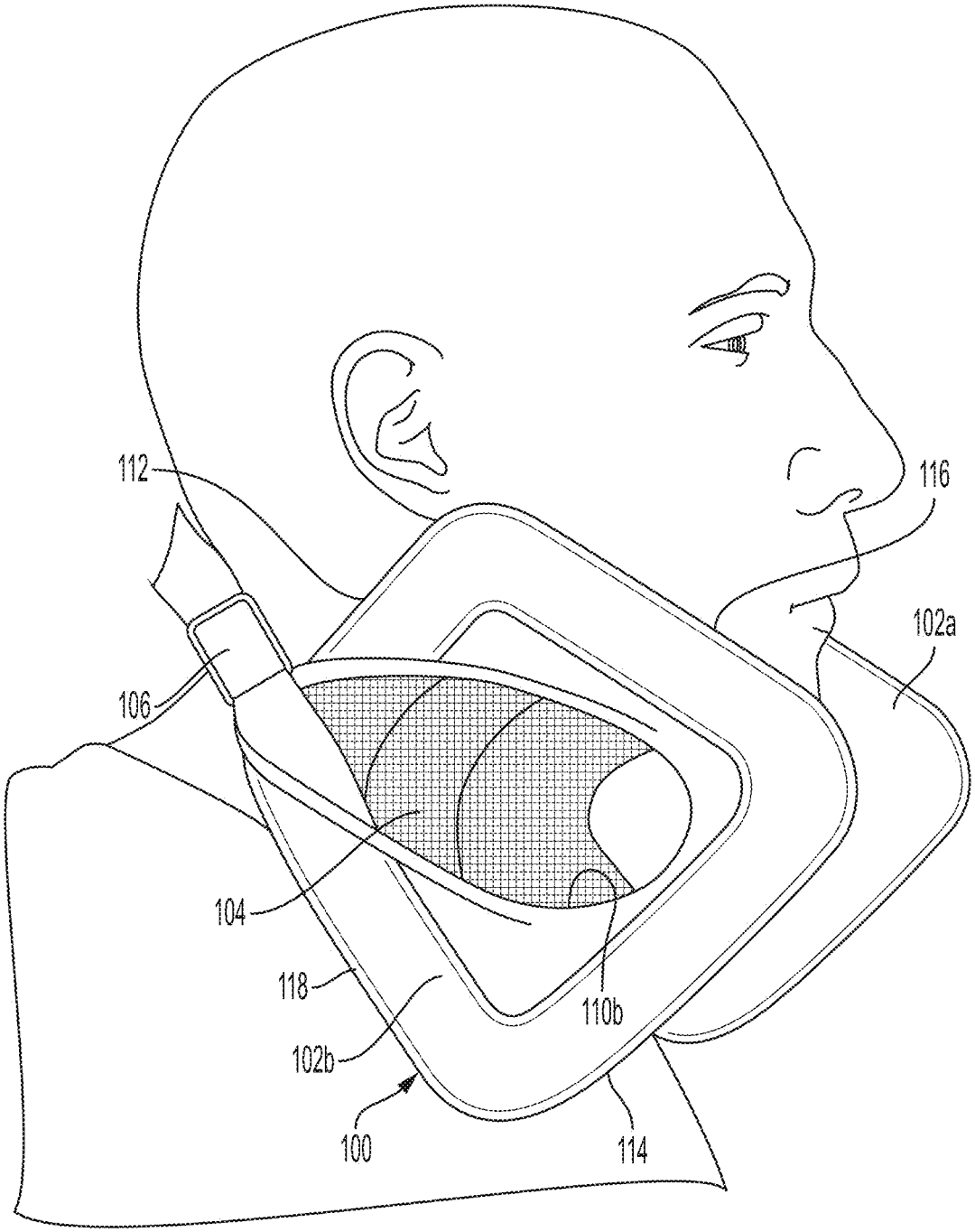
FIG. 7 is a side perspective view of the head support device shown in FIG. 1 while in use.
Figure 8:
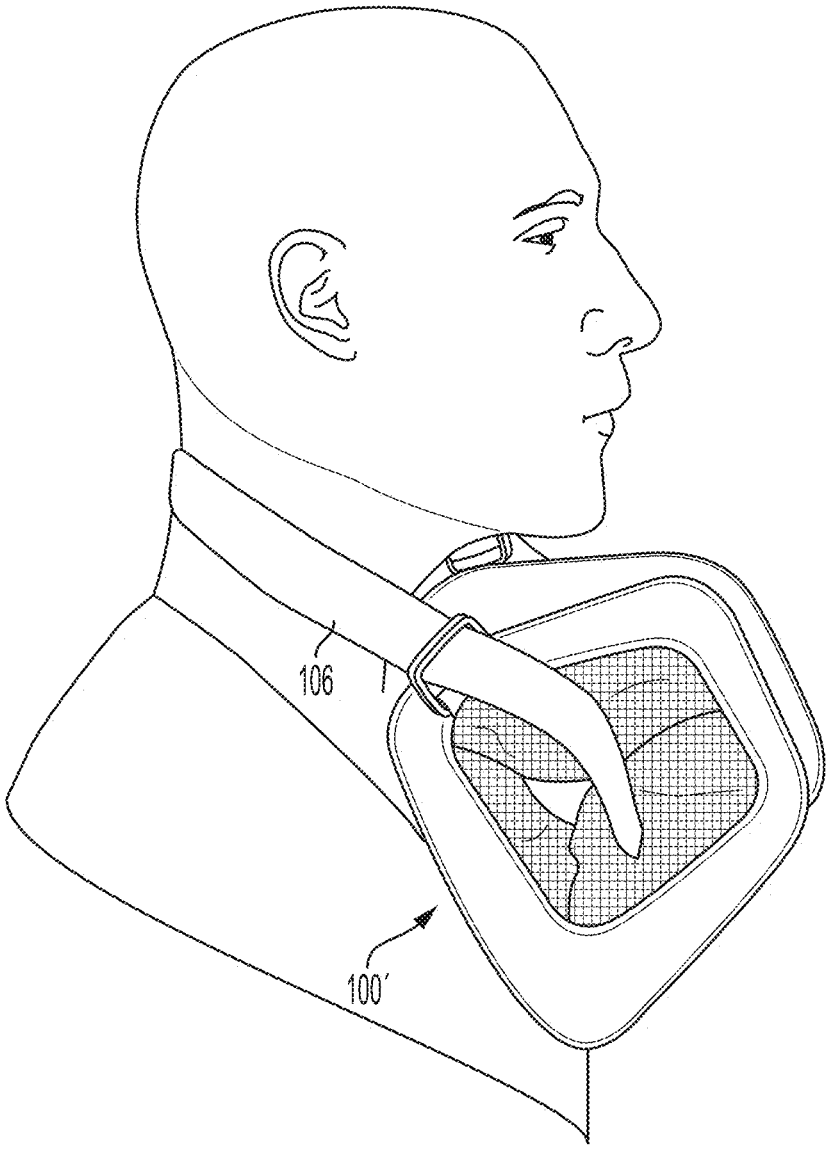
FIG. 8 is a side perspective view of the head support device shown in FIG. 1 while in use.
Figure 9:
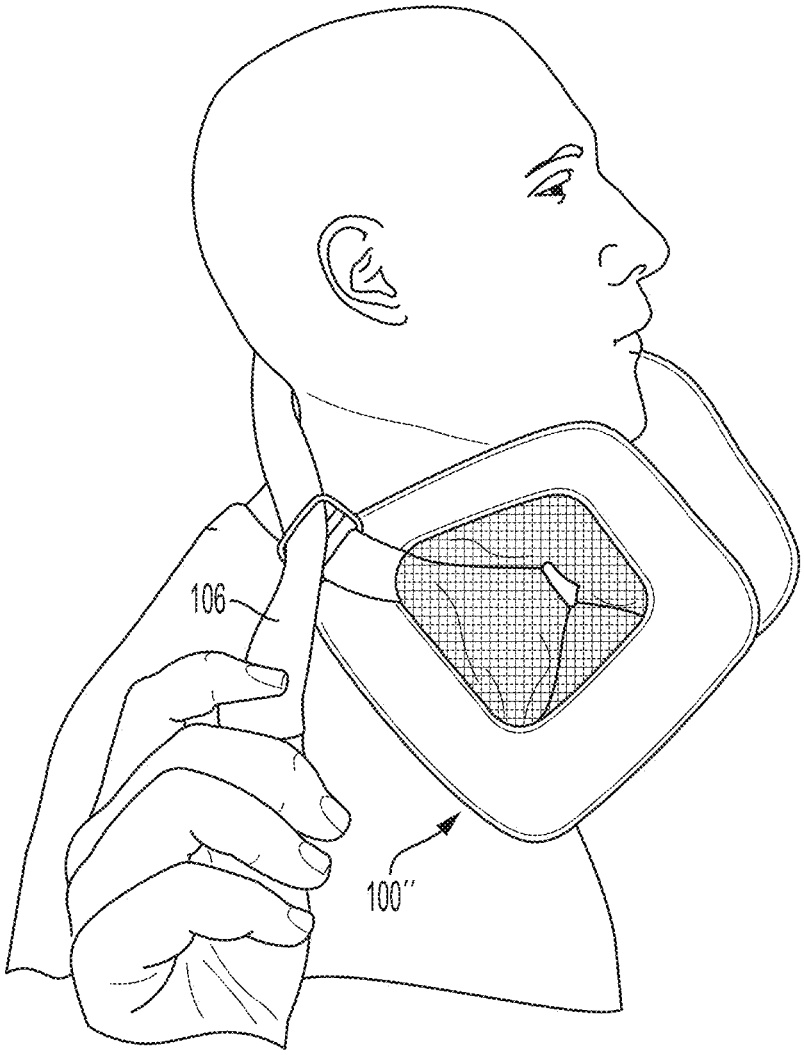
FIG. 9 is a side perspective view of the head support device shown in FIG. 1 while in use.
Figure 10A:
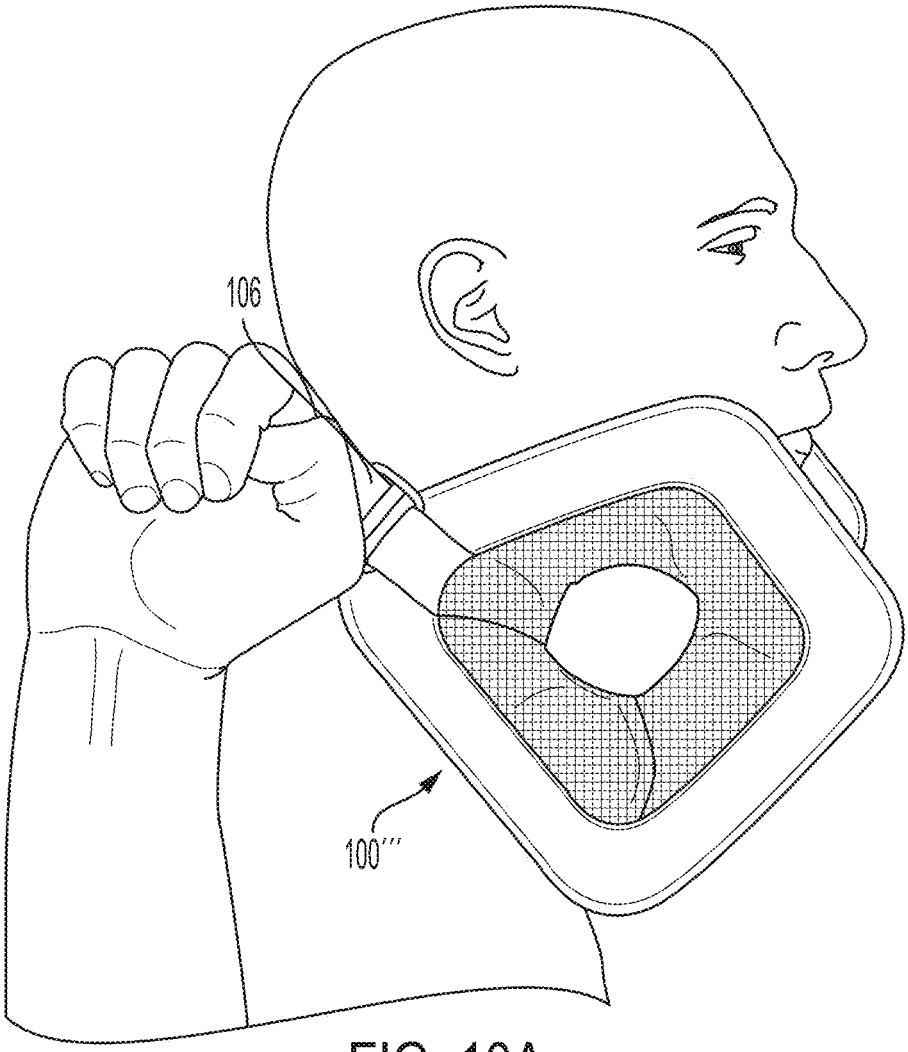
FIG. 10A is a side view of the head support device shown in FIG. 1 while in use.
Figure 10B:
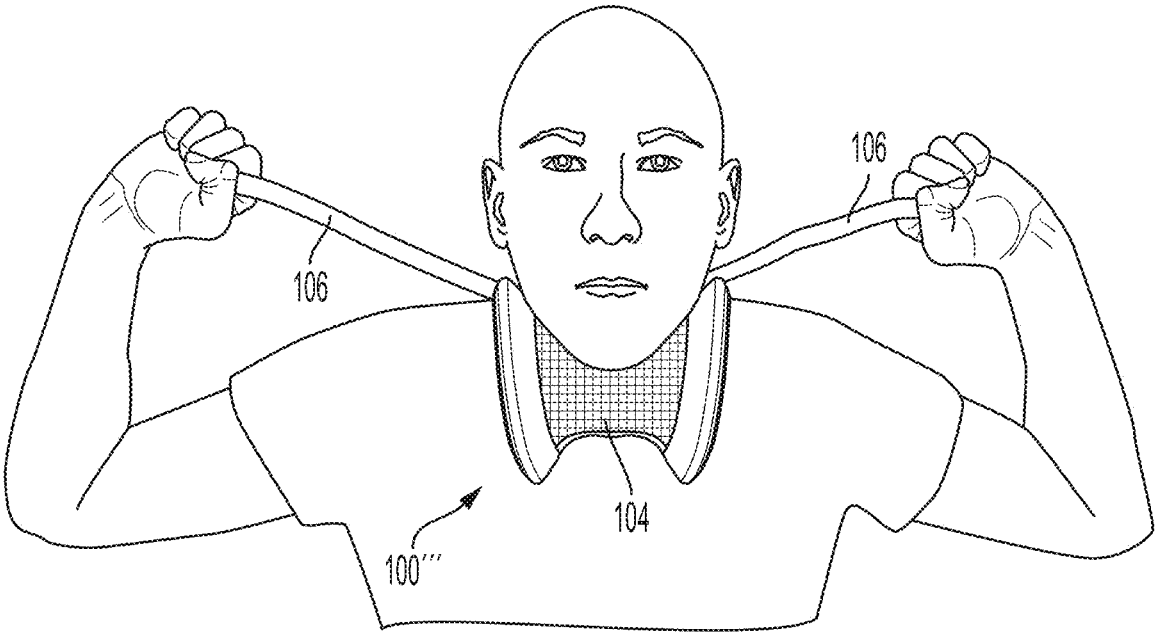
FIG. 10B is a front view of the head support device shown in FIG. 1 while in use.
Figure 11:
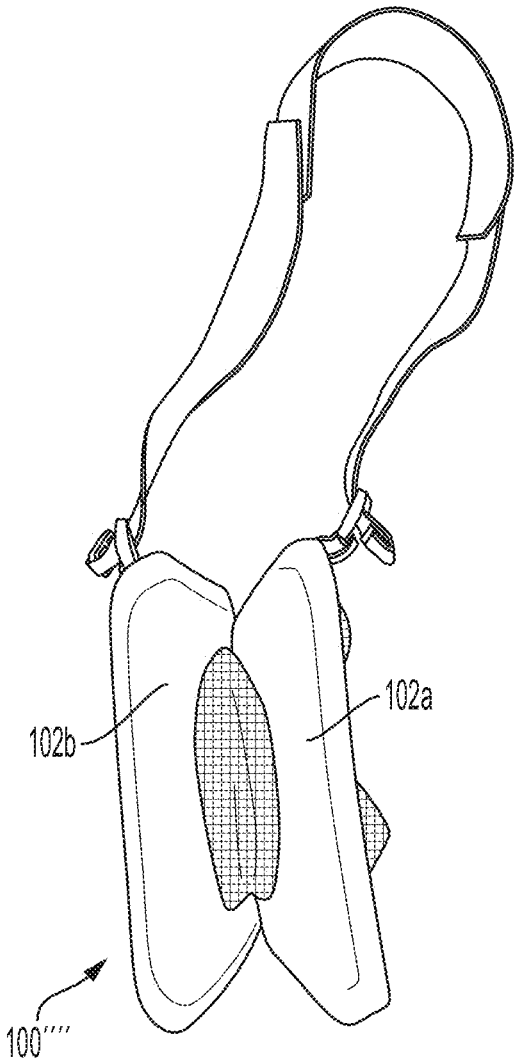
FIG. 11 is a first perspective view of the head support device shown in FIG. 1 in a collapsed configuration.
Figure 12:
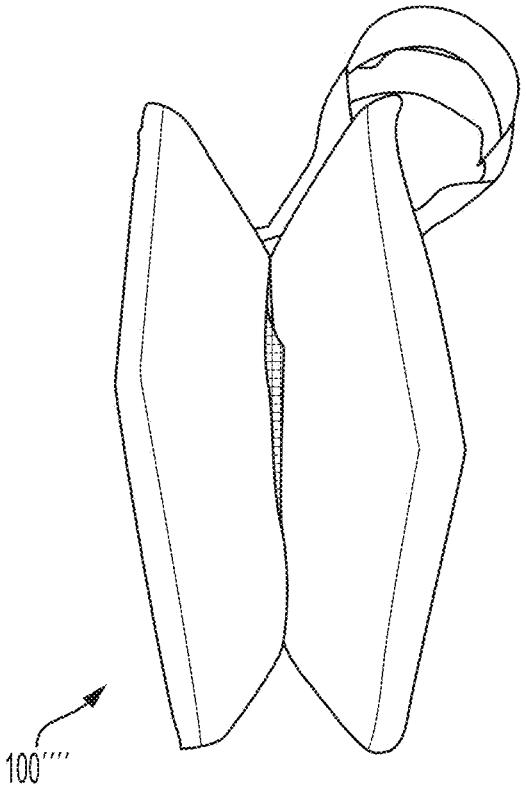
FIG. 12 is a second perspective view of the head support device shown in FIG. 1 in a collapsed configuration.

FIGS. 1-6 show various perspective views of a head support device 100 according to one embodiment of the present disclosure, with FIGS. 7-10B showing the head support device 100 in use by a user and FIGS. 11 and 12 showing the head support device in a collapsed or compacted configuration. In particular, FIGS. 1 and 2 provide two side perspective views of the head support device 100, FIG. 3 provides a top perspective view of the head support device 100, FIGS. 4 and 5 provide front-side perspective views of the head support device 100, and FIG. 6 provides another front perspective view of the head support device 100.

In some embodiments, the head support device 100 (as illustrated in FIGS. 1-12) is configured to provide support to a user's head, and is designed to be used in place of a traditional prior art travel pillow. The head support device 100 can include a variety of components, and in the specific embodiment shown includes first and second side supports 102*a*, 102*b*, a central support 104, and a connector 106. Both the central support 104 and the connector 106 run between the first and second side supports 102*a*, 102*b*, and connect the side supports 102*a*, 102*b* to one another, though it is understood that intervening elements may also be present. The central support 104 is designed to fit underneath a user's chin, while the connector 106 is designed to go around at least a portion and/or the back of a user's head or neck.

The side supports 102*a*, 102*b* can be configured to contact the outside of a user's jaw and/or a user's cheeks to, in combination with the central support 104, support a user's head, in addition to serving as structural supports for the central support 104. The side supports 102*a*, 102*b* can have various shapes, with the specific embodiment shown having a generally trapezoidal shape. The trapezoidal side cross-section of the side supports 102*a*, 102*b* as shown includes a shorter rear side 112 and a longer front side 114, with top side 116 and bottom side 118 connecting the rear and front sides 112, 114, as seen, for example, in FIG. 7. As can also be seen in FIG. 7, this generally trapezoidal shape is particularly adapted to support a user's head in that the bottom side 118, rear side 112, and top side 116 generally follow the outline of a person's chest, neck, shoulder, and chin, respectively, when the person's head is in a supported position. The bottom sides 118 of the side supports 102*a*, 102*b*, when in a tightened position such as that shown in FIG. 7, can abut a user's chest and/or shoulders and thus provide support to the head support device 100 as a whole, with the head support device 100 in turn supporting the user's head.

While the specific head support device 100 is shown as including generally trapezoidal side supports 102*a*, 102*b*, it is understood that side supports with a variety of different shapes are possible. For example, devices according to the present disclosure can include generally square, rectangular, trapezoidal, rhombus, other quadrilateral, circular, oval-shaped, triangular, pentagonal, hexagonal, octagonal, or other regular- or irregular-polygon shaped side supports. Other shapes are also possible, including circular side supports or side supports circle, oval, or other curved sections.

As can be seen in the front view of FIG. 4, the side supports 102*a*, 102*b* are vertically oriented in that they have heights larger than their widths, though embodiments not oriented in this manner are possible. The side supports 102*a*, 102*b* can include an inner surface 120 that has a height smaller than the height of its respective outer surface 122. The top surfaces 116 of the side supports 102*a*, 102*b* can slope upward from their respective inner surfaces 120 to their respective outer surfaces 122. This slope is beneficial in that it is generally shaped to follow the curve of a user's chin. Similarly, the bottom sides 118 of the side supports 102*a*, 102*b* can slope downward from their respective inner surfaces 120 to their respective outer surfaces 122, which can generally follow the shape of the user's chest in the areas where the bottom surfaces 118 will abut. Thus, in the embodiment shown, the front cross-section is shown as trapezoidal. It is understood that other front cross-sections of the side supports 102*a*, 102*b* are possible, such as generally square, rectangular, trapezoidal, rhombus, other quadrilateral, circular, oval-shaped, triangular, pentagonal, hexagonal, octagonal, or other regular- or irregular-polygon shapes. Many different embodiments and shapes are possible.

Side supports according to the present disclosure, such as the side supports 102*a*, 102*b*, can have various dimensions. For example, side support depth (i.e., in the horizontal direction in FIG. 3 and the vertical direction in FIG. 4) can be between 2" and 15" from front to back, between 3" and 12" from front to back, between 4" and 10" from front to back, between 5" and 7.5" from front to back, or approximately 6" from front to back. Side support height (i.e., in the vertical direction in FIG. 6) can be between 2" and 15" from top to bottom, between 3" and 12" from top to bottom, between 4" and 10" from top to bottom, between 5" and 7" from top to bottom, or approximately 5.5" from top to bottom. Side support width (i.e., in the vertical direction in FIG. 3 and the horizontal direction in FIG. 4) can be between 0.5" and 6" from outside to inside, between 0.75" and 4" from outside to inside, between 1" and 3" from outside to inside, or approximately 1.75" from outside to inside. It is understood that measurements outside these ranges are possible.

The side supports 102*a*, 102*b* can be made of many different materials, including combinations of materials. For example, in some embodiments the side supports 102*a*, 102*b* include a harder inner shell and softer padding thereon, with the inner shell providing more structural support and the padding providing user comfort. The side supports 102*a*, 102*b* may also include a cover on the outside thereof. Composition of side supports according to the present disclosure which can be utilized with regard to the side supports 102*a*, 102*b* will be discussed in more detail below with regard to FIGS. 13 and 14.

The central support 104 is designed to support a user's chin, and runs between the side supports 102*a*, 102*b*. In many prior art travel pillows, the legs of the pillow are brought together to provide support to a user's chin. However, this can result in heat and moisture collecting in the user's neck and chin areas, which can lead to discomfort. The central support 104 is configured to improve ventilation to this area while also providing sufficient support to the user's chin. Further, in some embodiments, the central support 104 may be collapsible and configured to allow the head support device 100 to be collapsible and easy to carry.

The central support 104 can be primarily made of a mesh, screen, and/or breathable material. The central support 104 can be primarily made of plastic, nylon (e.g., nylon screen material similar to that used in car window shades available from Dion™), composite (e.g., composite screen material similar to that used in the Aeron™ style of chair produced by Herman Miller™), rubber, cotton, polyester, wire, metal, or other materials, or any combination of materials. The central support in some embodiments is elastic, and in other embodiments is inelastic. Many different types of materials are possible and this listing of possible materials does not limit the types of materials that may be used.

When in use, the central support 104 is held in tension between the side supports 102*a*, 102*b* to provide support to the user's chin and head. As shown, for example, in FIGS. 2 and 9, the central support 104 has a generally hollow shape having a closed cross-section, such as a tube or sleeve shape having a polygon- or non-polygon cross-section. The cross-section can be, for example, quadrilateral, square, rectangular, trapezoidal, triangular, circular, oval-shaped, or another shape. The central support 104 can include open or closed ends, with the specific embodiment shown having open ends. A central support 104 with a closed cross-section such as that shown, as opposed to a central support with an open cross-section such as a typical sling or hammock device or a substantially two-dimensional fabric between the side supports 102*a*, 102*b*, can be beneficial in that it is more structurally sound for supporting the user's head, and in that it can be more securely connected to the side supports 102*a*, 102*b*. It is understood that sling or hammock style central supports are also possible in embodiments of the present disclosure.

Central supports such as the central support 104 can have various dimensions. For example, central supports according to the present disclosure can have a non-stretched length from side to side of between 2" and 18", between 3" and 12", between 4" and 8", or about 6". The central support 104 can have depth and height measurements that are equal or unequal, and the depths and heights can be, for example, between 0.5" and 6", between 1" and 4", between 1.5" and 3", or about 2". It is understood that measurements outside these ranges are possible.

In the specific embodiment shown, the side supports 102*a*, 102*b* include apertures 110*a*, 110*b* therein, such that the side supports 102*a* have both an outer perimeter and an inner perimeter. The apertures 110*a*, 110*b* (and thus the inner perimeters of the side supports 102*a*, 102*b*) can have a cross-section substantially matching the cross-section of the central support 104, though other embodiments are possible. The central support 104 can connect to the side supports 102*a*, 102*b* at the apertures 110*a*, 110*b*, such as within the apertures 110*a*, 110*b*, or in some embodiments go partially or entirely through the apertures 110*a*, 110*b*. This connection between the central support 104 and the side supports 102*a*, 102*b* is more secure than, for example, a simple sling-like structure connecting to the inside surfaces of the side supports 102*a*, 102*b*, such a structure being prone to tearing or detachment from the side supports. In some embodiments the central support 104 connects to the outer surfaces of the side supports 102*a*, 102*b*. In some embodiments the central support 104 connects to the outer perimeter of the side supports 102*a*, 102*b*, whether it passes through the apertures 110*a*, 110*b* first or not. Some attachment configurations and components that can be used as part of the head support device 100 are described in more detail below with regard to FIGS. 13 and 14.

Additionally, it is understood that apertures may not be present in certain embodiments of the present disclosure. For example, instead of apertures going through each side portion, each side portion could include one or more recessed areas on its inside surface, and the central support could connect to the side supports within these recessed areas. Other embodiments not including apertures or recessed areas are also possible.

The central support 104 can be collapsible. For example, FIGS. 11 and 12 are perspective views showing the head support device 100 in a collapsed configuration 100"". This configuration is possible because the central support 104 can be collapsed or compacted (as opposed to being tensioned as shown in, e.g., FIGS. 10A and 10B). When in the collapsed configuration 100"", the side supports 102*a*, 102*b* are proximate or contacting one another, and the overall volume of the head support device 100 is smaller than when in use, making storage and packing of the head support device 100 easier.

The head support device 100 includes a connector 106 for going around the rear of a user's head and/or neck. The connector in some embodiments is elastic, and in some other embodiments is inelastic. The connector 106 can be a strap or similar device, and can have an adjustable operable length. For instance, in the embodiment shown the head support device 100 includes length adjustment components 108, such as ladder lock style components. The adjustment components 108 can connect the connector 106 to the main body of the head support device 100, such as to the side supports 102*a*, 102*b*. The connector 106 can have various maximum operable lengths (i.e., length when the connector 106 is at its loosest), such as maximum operable lengths of between 6" and 36", between 8" and 24", between 12" and 22", or about 18". The maximum operable length can be long enough such that a user can comfortably pull the head support device 100 on or remove the head support device 100 over the user's head. It is understood that measurements outside these ranges, including embodiments where a user cannot remove or put on the head support device 100 as described, are possible.

The connector 106 can be adjusted to achieve different positions of the head support device as a whole. For example, in FIG. 8, the connector 106 is loose such that the head support device 100 is in a first position 100' that is loose and not in use by the user, and the central support 104 in this embodiment may be slack. In FIG. 9, the connector 106 has been tightened so as to have a shorter operable length, such that the head support device 100 is in a second position 100" where it is drawn much closer to the user's neck and chin. Users who prefer a very loose connection may use the head support device 100 in the second position 100" or a similar position. In FIGS. 10A and 10B, the connector 106 has been tightened even further to a third position 100", which fits snugly to the user's neck and chin area, which may be preferred by users who prefer a more stable head support device. Connector 106 can be tightened from only one side or, as shown in FIG. 10B, in some embodiments can be tightened from both sides. In the position 100''', the central support 106 is held in tension between the side supports 102*a*, 102*b*, as can be seen in FIG. 10B.

Figure 13:
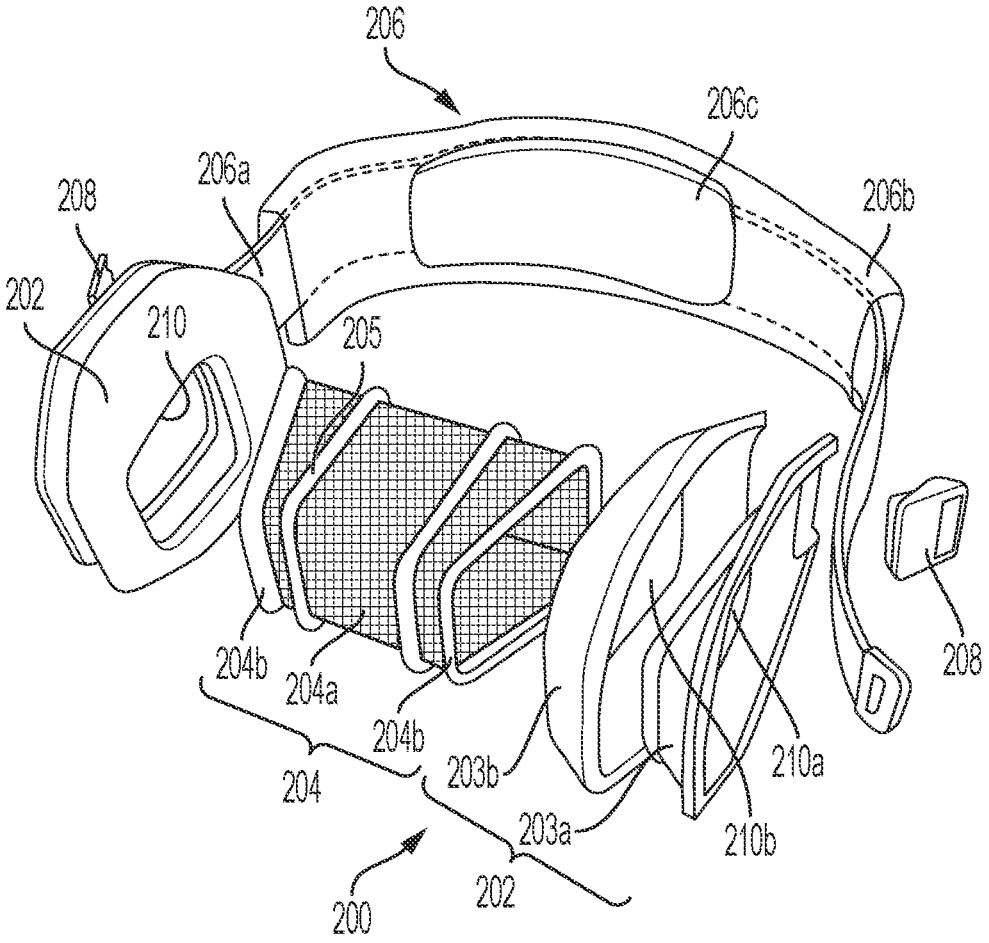
FIG. 13 is an exploded perspective view of a head support device according to another embodiment of the present disclosure.
Figure 14:
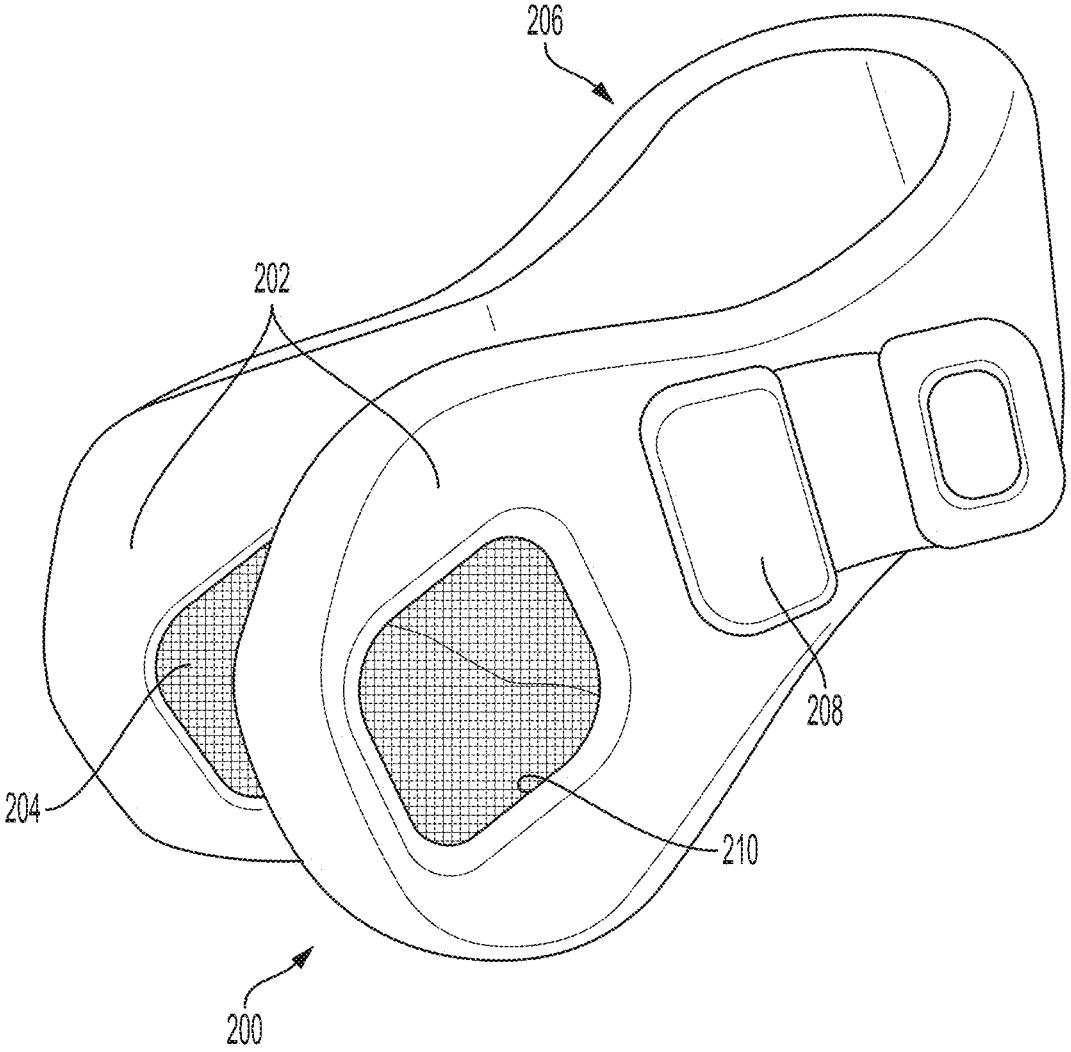
FIG. 14 is a perspective view of the head support device shown in FIG. 13.

FIGS. 13 and 14 show another embodiment of a head support device 200. In particular, FIG. 13 provides a partially exploded view of a head support device 200, and FIG. 14 provides a perspective view of the head support device 200. The head support devices 100 and 200 can include many elements that are the same or similar, and it is understood that characteristics and elements of one can be used in the other. The head support device 200 includes two side supports 202, a central support 204, a connector 206, and one or more adjustment components 208. The connector 206 may include a main body 206*a* such as a strap. Optionally, the connector 206 may also include a cover 206*b* and/or padding 206*c* for user comfort. The cover 206*b* and/or padding 206*c* may be configured to surround at least a portion of the main body 206*a*. The adjustment components 208, in addition to being used to adjust the operable length of the connector 206, can also include a release functionality as shown in FIG. 13 on one or both sides. This can be especially useful for users who disfavor putting the head support device 200 on or removing the head support device 200 via an over-the-head motion, as the release functionality means that the head support device 200 can be easily put on or removed from the side.

The side supports 202 in the embodiment shown include multiple parts which can serve different primary purposes. First, each of the side supports 202 includes a frame portion 203*a*. The frame portions 203*a* can provide its respective side support 202 with structure, shape, and stability. The frame portions 203*a* can be shells, can be cup-shaped, can have vertical cross-sections that are substantially outwardly C-shaped, and/or can be concave or have a concave outside surface with respect to the side of its respective side support 202 facing away from the user (the "outside," as opposed to the side of the side support 202 facing the user and the opposing side support 202, or the "inside"). These shapes allow the frame portions 203*a* to both firmly support a user's head and jaw, while also in some embodiments allowing for a certain amount of flex for user comfort.

The frame portions 203*a* can be made of many different materials, including but not limited to plastics such as injected molded plastics, composite materials, fiberglass, polymers, metals, foam such as memory roam, rubber, other rigid materials, and combinations thereof. Many different embodiments are possible, and this listing of possible materials does not limit the types of materials that may be used in frame portions according to the present disclosure.

Second, each of the side supports 202 includes a pad portion 203*b*. The pad portions 203*b* are designed to be the portions of the side supports 202 that abut a user's head, such as their jaw and cheeks. The pad portions 203*b* can be shaped similarly to the frame portions 203*a*, and can be shaped to accommodate the frame portion in a cavity therein as shown in FIG. 13. In the embodiment shown each of the pad portions 203*b* covers only the inside surface of its respective frame portion 203*a*, though other embodiments where the outside surface is also covered and/or the frame portions are surrounded by the pad portions are also possible.

While the pad portions 203*b* can assist in giving the side portions 202 structure, shape, and strength, they are in some embodiments less rigid than their underlying frame portions 203*a*. This less rigid material can provide a buffer between the user and the more rigid frame portion, thus providing greater comfort. The pad portions 203*b* can be made of many different materials, including but not limited to foam, memory foam, cotton, polyester, polyfill, cloth, linen, and combinations thereof, and in some embodiments can also include filling, such as polyfill, microbeads, feathers, traditional bed pillow filling materials, other filling materials, and combinations thereof. Many different embodiments are possible, and this listing of possible materials does not limit the types of materials that may be used in frame portions according to the present disclosure.

Like the side portions 102*a*, 102*b* from the head support device 100, the side supports 202 of the head support device 200 include apertures 210 therethrough. In this case, the apertures 210*a*, and 210*b*, respectively are through both the frame portions 203*a* and the pad portions 203*b*. The central support 204 can attach to the side portions 202 by at least partially traversing each of the apertures 210. In the embodiment shown, the central support 204 includes a main body 204*a*, and two collars 204*b*, which in some embodiments are end collars on the ends of the main body 204*a* as shown. In other embodiments the collars 204*b* may not be end collars. The collars 204*b* can be thicker than the main body 204*a*, and/or can be stronger than the main body of the central support 204, so as to give the central support 204 structure and shape as well as prevent fraying or tearing of the main body 204*a*. The collars 204*b* can include material that is different than the material of the main body 204*a*, either in addition to or in place of that material. For instance, in one embodiment the collars 204*b* include internal wire; in another embodiment the collars 204*b* include elastic.

Also shown in FIG. 13 are two retaining members 205 separate from the central support 204. The retaining members 205 can made of materials similar to or the same as the side supports 202. Additionally, the retaining members 205 can mate or otherwise attach with the side supports 202, and can, combined with the side supports 202, secure the central support 204 by securing the position of the collars 204*b*. For example, in some embodiments the main body 204*a* includes mesh that is configured to be sewn to a solid structure of layered fabric leather or insert molded with a solid plastic structures. Further, in some embodiments, the solid plastic structures may be captured by or sewn to one of the frame portions 203*a* which may include plastic shells.

In one embodiment, whereas the main body 204*a* of the central support has a cross-section that is smaller than that of the apertures 210 of the side supports 202, the cross-sections of the collars 204*b* can be larger than the cross-section of the apertures 210. In this way, once the collars 204*b* are passed through the apertures 210 (such as by being temporarily compacted), the side supports 202 (in some embodiments, in combination with the retaining members 205) can prevent the central support 204 from re-traversing the apertures 210, thus suspending the central support 204 between the side supports 202.

The central support 204 can also be attached to the side supports 202 in other ways, either in addition to or in place of use of retaining members and/or collars as described above. For instance, the central support 204 can be attached to the side supports 202 using co-injection molding, adhesives such as glue or epoxy, fasteners such as staples, screws, nails, brackets, threading, male/female connections, other attachment means as known in the art, or combinations thereof. Additionally, these attachment means may be used in combination with attachment via the retaining members 205.

Figure 15A:
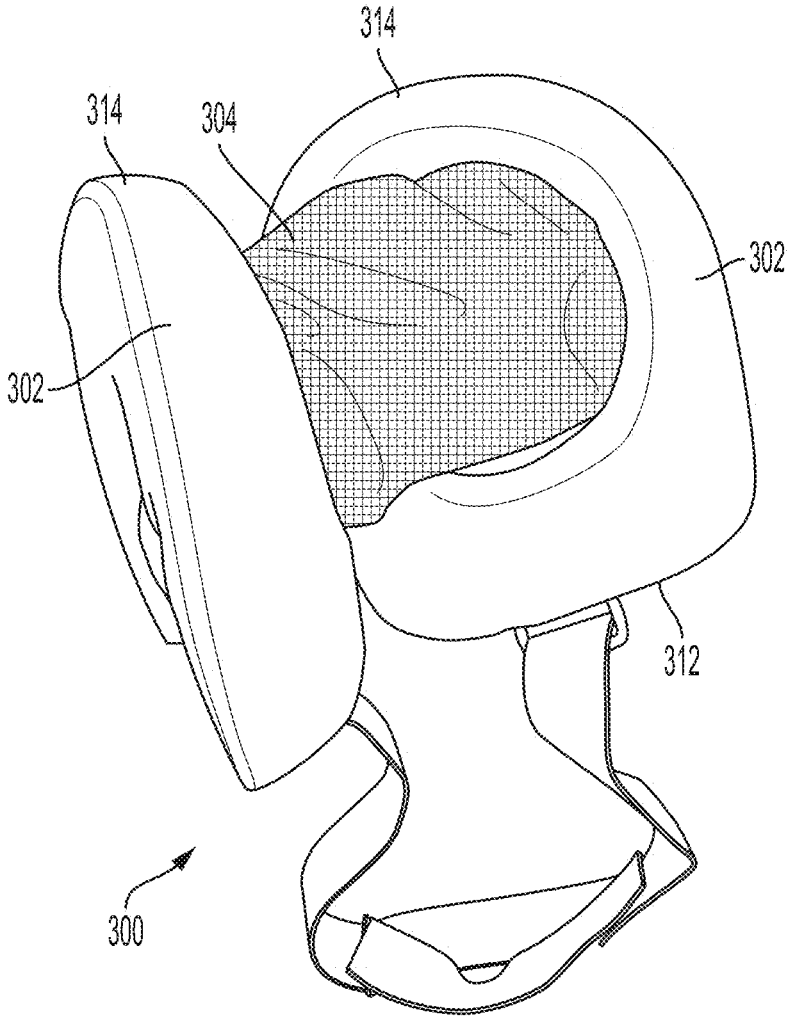
FIG. 15A is a perspective view of another embodiment of a head support device according to an aspect of the present disclosure.
Figure 15B:
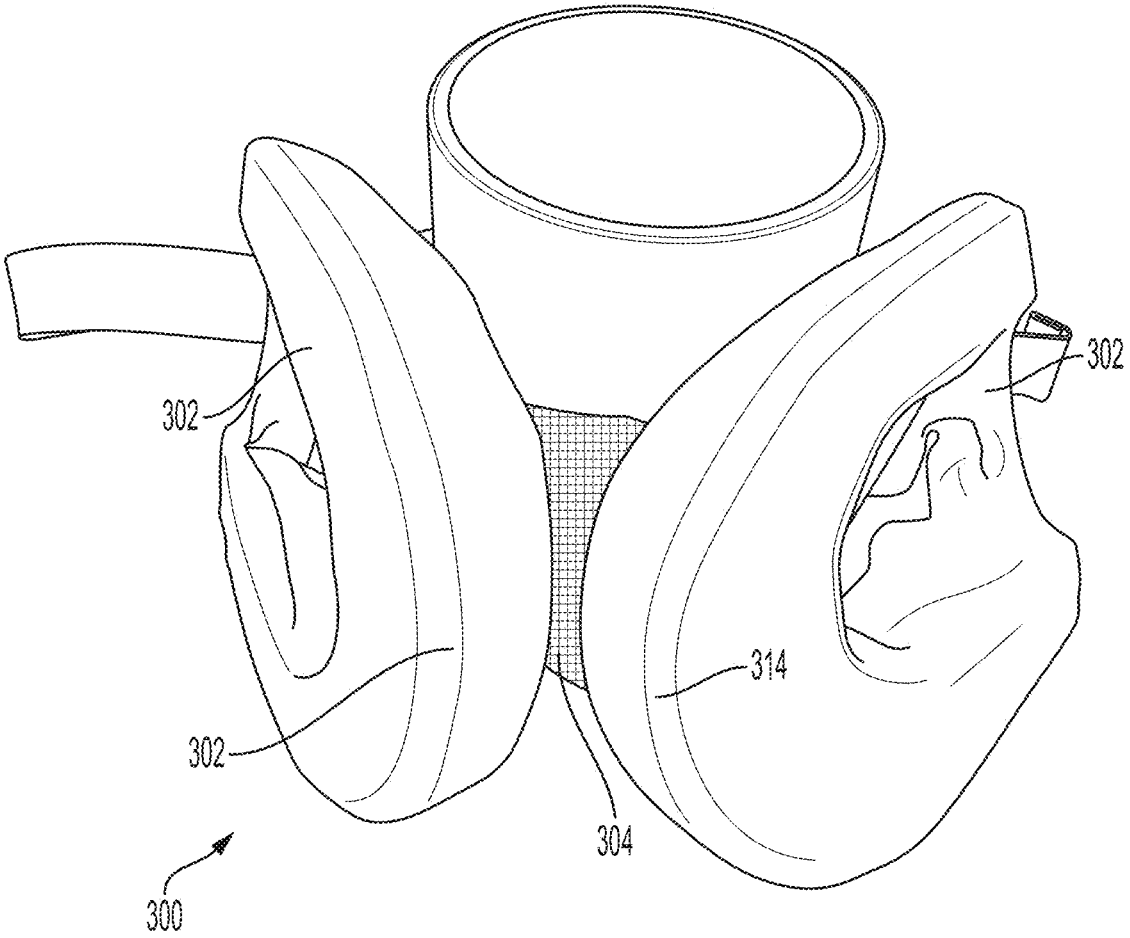
FIG. 15B is a perspective view of another embodiment of a head support device according to an aspect of the present disclosure.
Figure 15C:
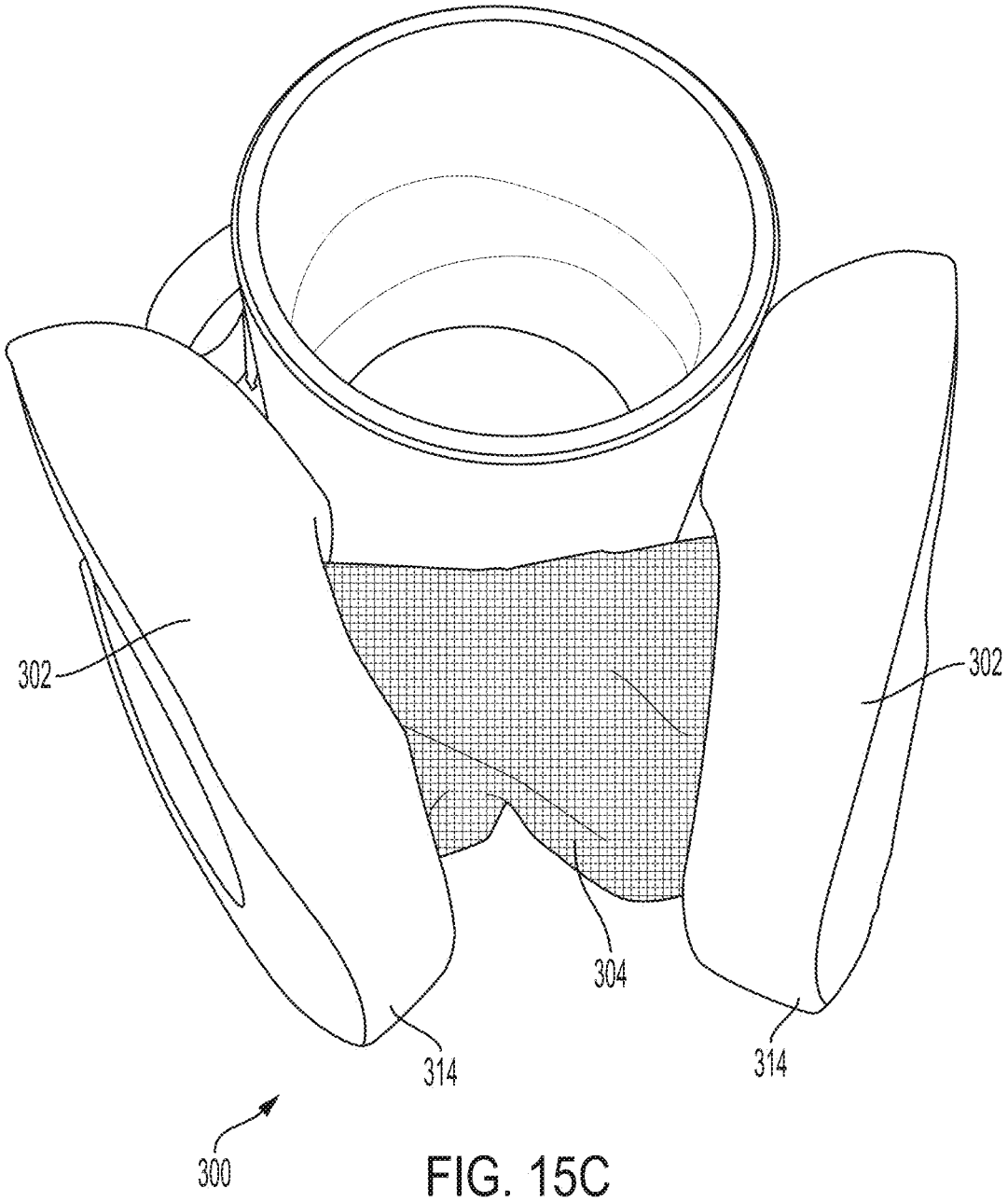
FIG. 15C is a perspective view of another embodiment of a head support device according to an aspect of the present disclosure.
Figure 15D:
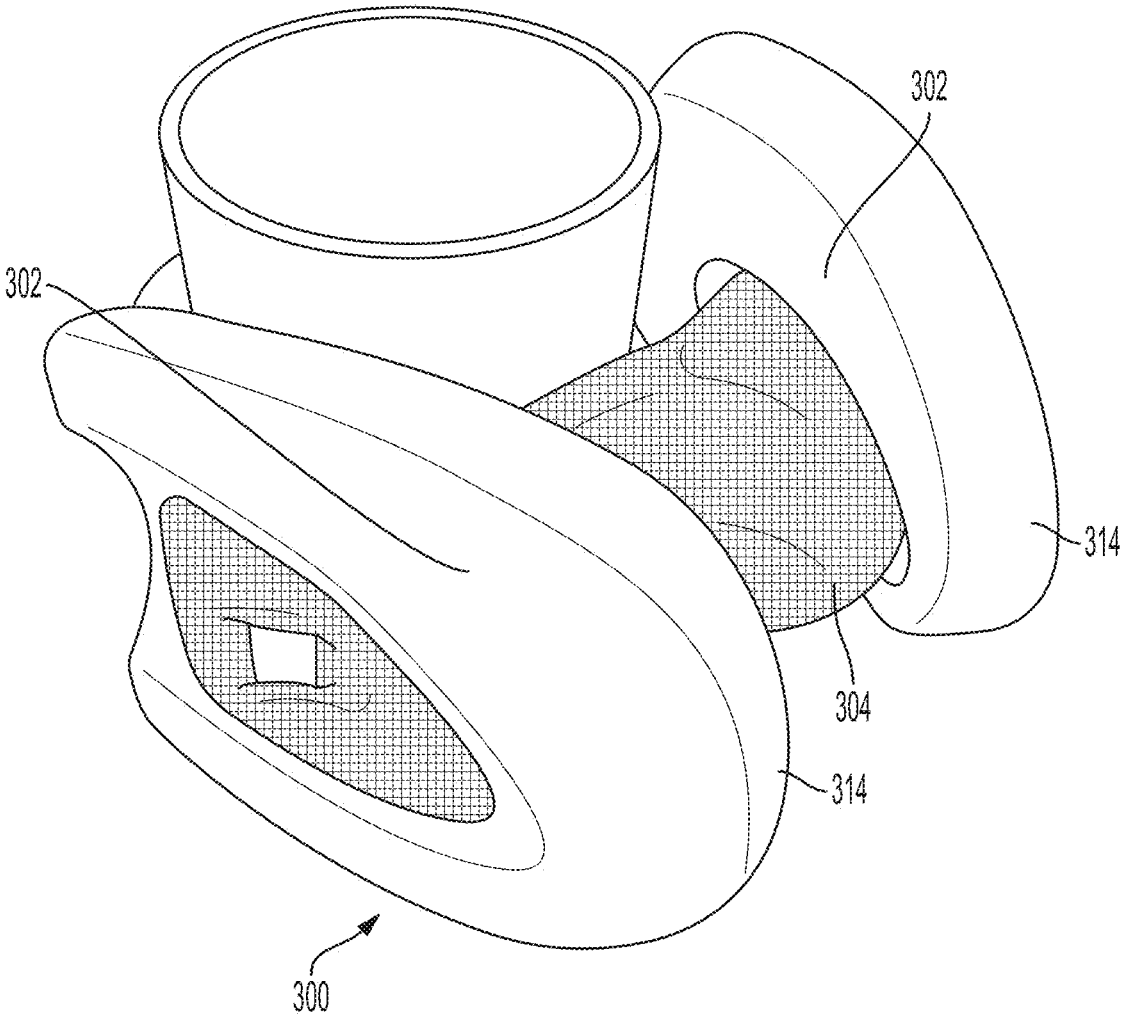
FIG. 15D is a perspective view of another embodiment of a head support device according to an aspect of the present disclosure.

FIGS. 15A-15D illustrate another embodiment of a head support device 300 including side supports 302. In particular, FIG. 15A illustrates a first perspective view of the head support device 300. FIG. 15B illustrates a front perspective view of the head support device 300 engaged around a collar (approximating a user's neck). FIG. 15C illustrates a top perspective view of the head support device 300. FIG. 15D illustrates a side perspective view of the head support device 300. The side supports 302 have front sides 314 that are more rounded, and rear sides 312 that are approximately the same height as the front sides 314 but are substantially straight. Side supports 302 may be connected by central support 304. Many different embodiments are possible, and it is understood that differently-shaped side supports can be interchanged with one another from embodiment to embodiment while maintaining the same characteristics of other components of the head support device.

Figure 16A:
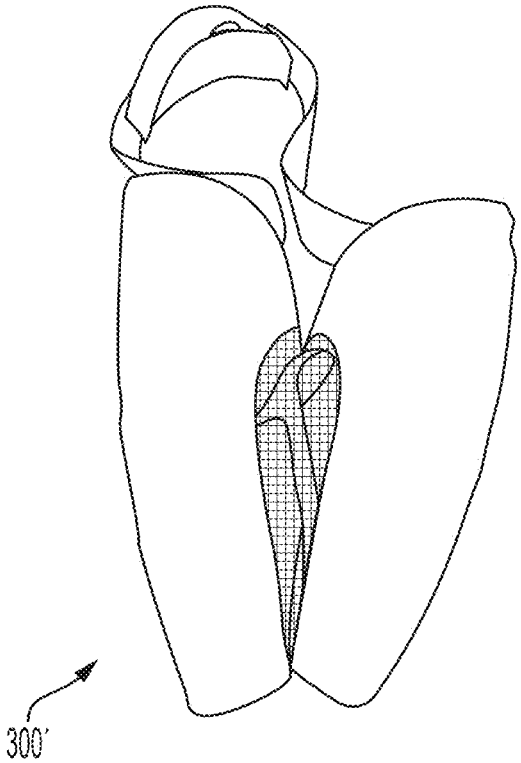
FIG. 16A is a first perspective view of the head support device shown in FIGS. 15A-15D in a collapsed configuration.
Figure 16B:
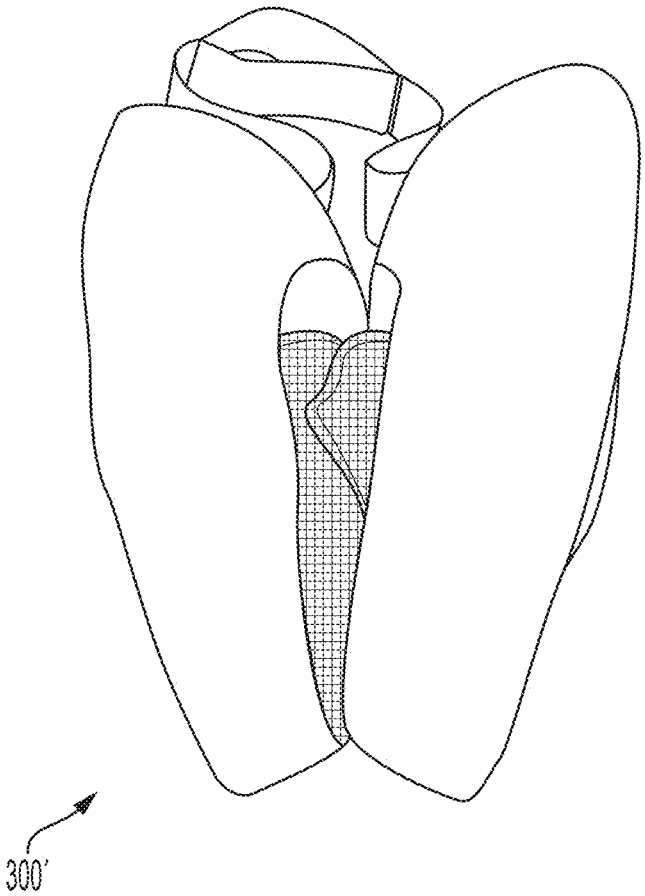
FIG. 16B is a second perspective view of the head support device shown in FIGS. 15A-15D in a collapsed configuration.

FIGS. 16A and 16B illustrate two top perspective views of the head support device of FIGS. 15A-15D. In particular, as illustrated in FIGS. 16A and 16B the head support device 300 of FIGS. 15A-15D can also be collapsible, with FIGS. 16A and 16B showing the head support device 300 in a collapsed configuration 300'.

Figure 17A:
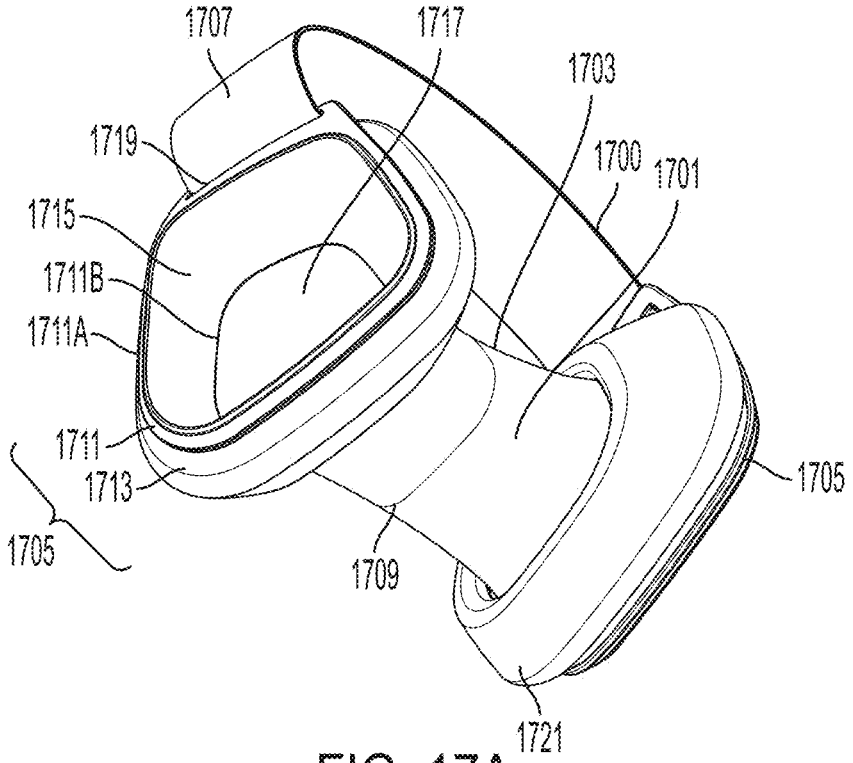
FIG. 17A is a first perspective view of an embodiment of the head support device in accordance with an aspect of the present disclosure.
Figure 17B:
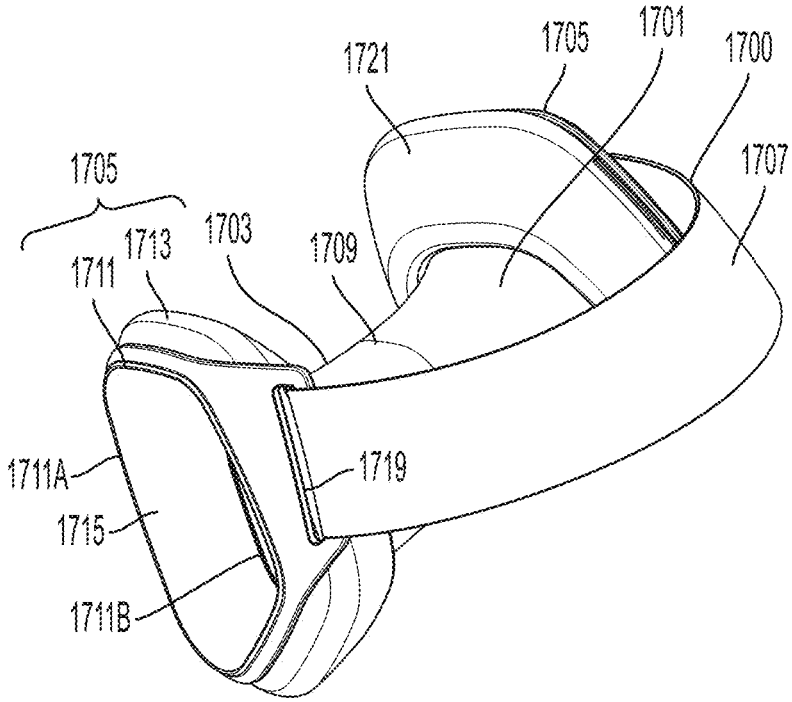
FIG. 17B is a second perspective view of the embodiment of the head support device illustrated in FIG. 17A.
Figure 17C:
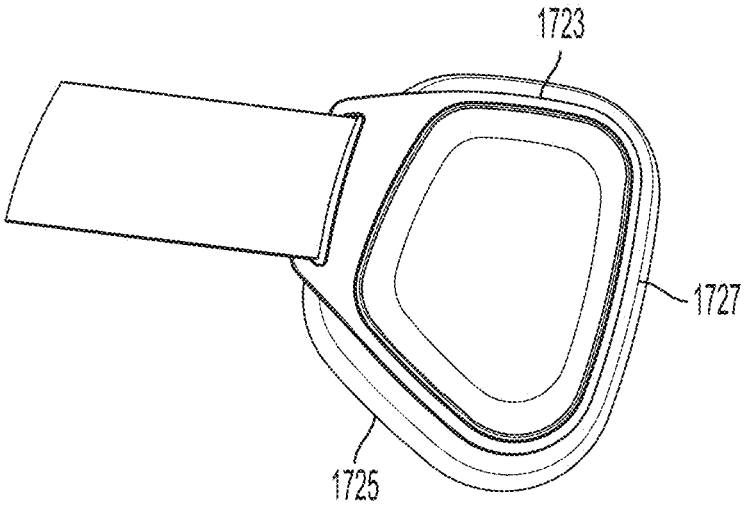
FIG. 17C is a side view of the embodiment of the head support device illustrated in FIGS. 17A-17B.
Figure 17D:
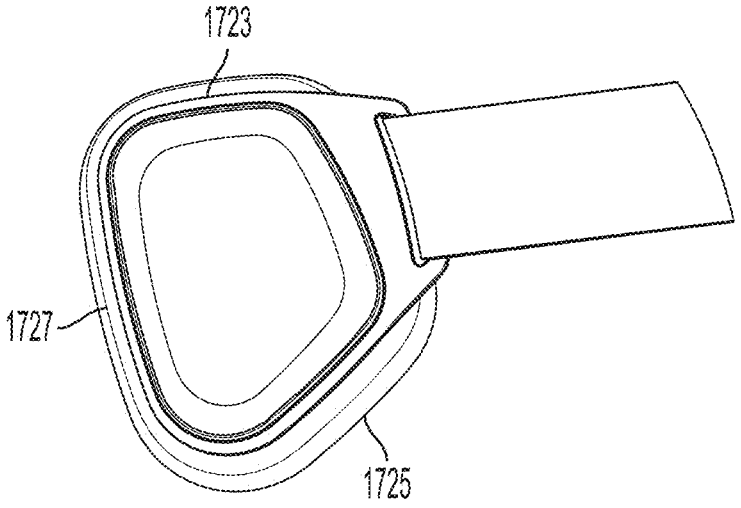
FIG. 17D is a second side view of the embodiment of the head support device illustrated in FIGS. 17A-17C.
Figure 17E:
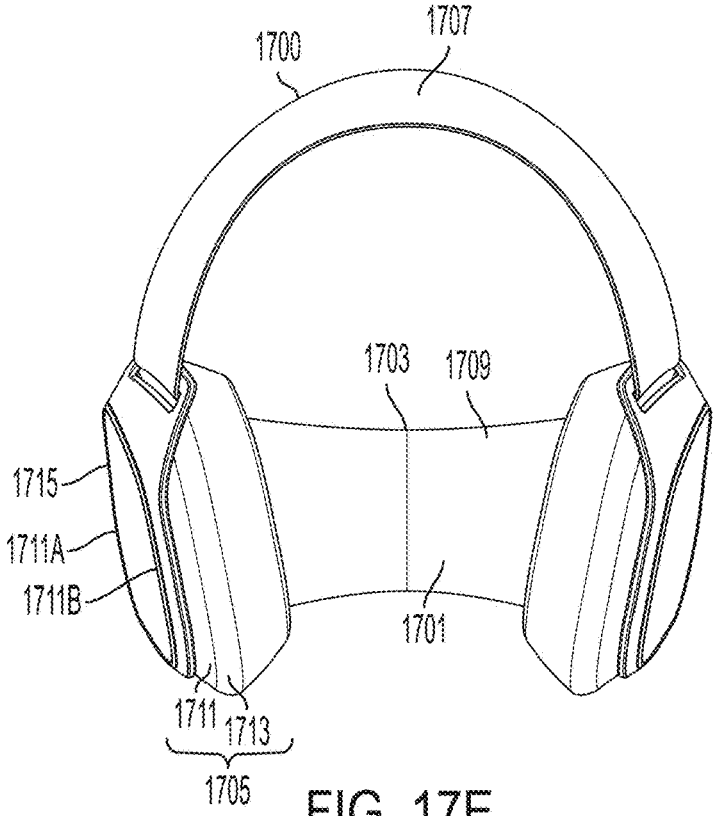
FIG. 17E is a top perspective view of the embodiment of the head support device illustrated in FIGS. 17A-17D.
Figure 17F:
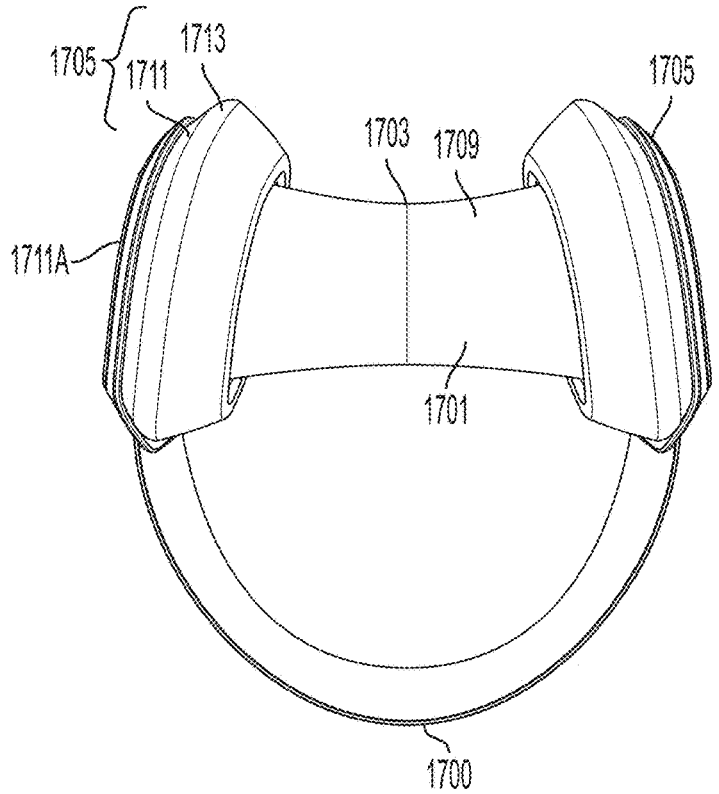
FIG. 17F is a bottom perspective view of the embodiment of the head support device illustrated in FIGS. 17A-17E.
Figure 17G:
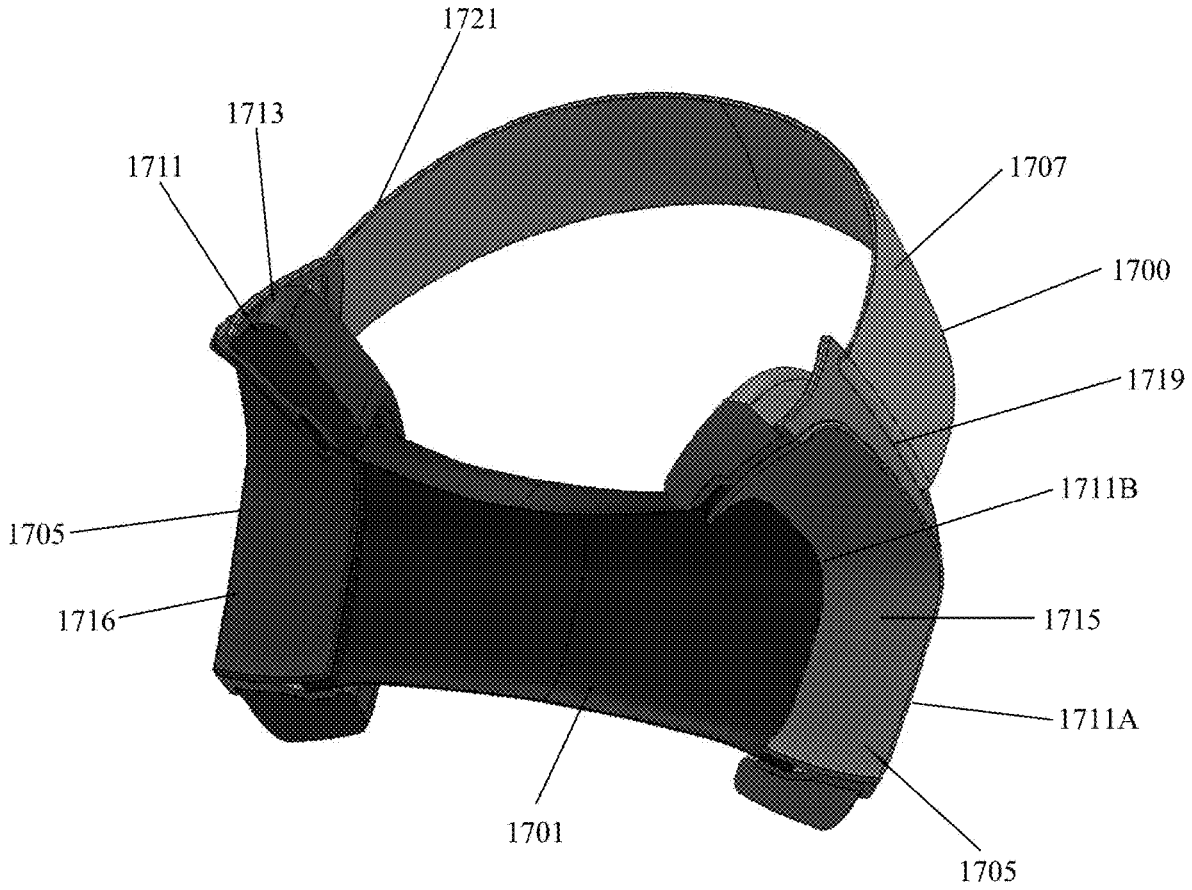
FIG. 17G is a cross-sectional view of the embodiment of the head support device illustrated in FIGS. 17A-17F.

FIG. 17A is a first perspective view of an embodiment of the head support device in accordance with an aspect of the present disclosure. FIG. 17B is a second perspective view of the embodiment of the head support device illustrated in FIG. 17A. FIG. 17C is a side view of the embodiment of the head support device illustrated in FIGS. 17A-17B. FIG. 17D is a second side view of the embodiment of the head support device illustrated in FIGS. 17A-17C. FIG. 17E is a top perspective view of the embodiment of the head support device illustrated in FIGS. 17A-17D. FIG. 17F is a bottom perspective view of the embodiment of the head support device illustrated in FIGS. 17A-17E. FIG. 17G is a cross-sectional view of the embodiment of the head support device illustrated in FIGS. 17A-17F.

In particular, FIGS. 17A-17G illustrate a head support device 1700 having a central support 1701. In some embodiments, the central support 1701 may include an upper surface 1703 configured to receive at least a portion of a user's chin. In some embodiments, the upper surface 1703 may be concave. In some embodiments, the upper surface 1703 may be shaped as an elongated "U." The central support 1701 may have a first end spaced apart from a second end. Each of the first and second ends may terminate in a side support 1705. The central support 1701 may also include a lower surface 1709 that is also concave. The lower surface 1709 may be configured to face a user's chest when the head support device 1700 is in use. The central support 1701 may include fabric having ventilation apertures, and/or padding to provide additional support and cushioning to a user's chin, chest, shoulder, and related areas. In some embodiments the central support 1701 includes a hollow interior. In some embodiments, the central support 1701 is breathable. In some embodiments, the central support includes at least one of a mesh and a screen. In some embodiments, the central support is at least one of flexible and collapsible.

In some embodiments, the head support device 1700 may include a connector element 1707 having a first end configured to attach to the side support at the first end of the central support and a second end configured to attach to the side support at the second end of the central support. In some embodiments, the connector element 1707 may be configured to encircle a portion of the user's head and/or neck. For example, the connector element 1707 may include a strap and buckle and the like. In some embodiments, the strap includes at least one of an adjustable operable length and one or more portions detachable from one another. In some embodiments, the connector element 1707 may include Velcro® and the like. In some embodiments, a portion of the connector element 1707 is configured to attach to a second portion of the connector element 1707 in a manner that is adjustable. In some embodiments, the connector element 1707 may be configured to wrap around and connect to the central support 1701 proximate the lower surface of the central support 1701. In some embodiments, the connector element 1707 may include neoprene, plastic or other interwoven components.

In some embodiments, a side support 1705 may have a substantially trapezoidal shaped cross section. The side support 1705 include a frame portion 1711 and a padded portion 1713. In the embodiment illustrated in FIGS. 17A-17F, the frame portion 1711 is configured to have a first trapezoidal outer perimeter 1711A, and a second trapezoidal inner perimeter 1711B that is connected by a inwardly sloping surface 1715. The interior of the frame portion 1717 is hollow and configured to align with the hollow portion of the central support 1701. The frame portion 1711 of the side support may include an aperture 1719 configured to connect to the connector element 1707. In some embodiments, each of the side supports 1705 may include a concave shape from the outside thereof.

The frame portion 1711 may be composed of plastics and the like. The frame portion 1711 may include rigid material configured to retain their shape. The frame portion 1711 may attach to a padded portion 1713. The padded portion 1713 may include a rear surface 1721, that is shaped to be ergonomic to a user. Indeed, the rear surface of the padded portion 1713 may be angled outwards and shaped to conform to a person's neck area. In some embodiments, the padded portion 1713 may be formed of memory foam, mesh, and/or similar materials. In some embodiments the connector element 1707 plus the side supports 1705 may keep the central support 1701 (which may be formed of mesh) under tension. Additionally, in some embodiments the padded portion 1713 may be formed of memory foam material, and/or mesh material, and the like.

The side support 1705 may include a top surface 1723 configured to extend essentially horizontally along a plane at and/or below the user's chin. The side support may also include a vertical surface 1727 that is configured to extend substantially vertically away from a user. The side support may also include a lower surface 1725 that is configured to engage with the neck and collarbone area and support and position the head support device 1700.

FIG. 17G illustrates a cross-sectional view of the head support device 1700. As illustrated, the cross-sectional view cuts a portion of the central 1701 and the corresponding side supports 1705. As illustrated in FIG. 17G, a cross-section of a first side support 1705 is shown with a cover plate 1716 configured to mechanically or adhesively fit within the side support 1705. In some embodiments, the cover plate 1716 may provide additional structure to the head support device 1700. Alternatively, in some embodiments, the cover plate 1716 may be cosmetic in nature. A cross-section of a second side support 1705 is illustrated without a corresponding cover plate 1716. In the illustrated embodiment, elements of the head support device 1700 including the rear surface 1721, padded portion 1713, and central support 1701 may include foam covered with mesh. In the illustrated embodiment, elements of the head support device 1700 including the frame portion 1711, connector element 1707, and cover plate 1716 may include plastic such as neoprene and the like.

In some embodiments, the illustrated components of the cross section including the padded portion 1713, central support 1701, frame portion 1711, connector element 1707, and cover plate 1716 may be connected via a mechanical fit (e.g., snap fit, raised surfaces that interface with holes on a corresponding surface), adhesives, and/or sewn.

In some embodiments, at least one of a bottom surface 1709 of the central support 1701, and the side supports 1705 are configured to engage with at least a portion of at least one of a user's chest, neck, shoulder, and collarbone. In some embodiments, each of the first end and the second end of the central support 1701 each includes a retaining member configured to secure the central support 1701 to the respective side support 1705. In some embodiments, each of the first end and the second end of the central support teach includes a collar for attachment to the side support. In some embodiments the respective ends of the connector element attaches to a frame portion of the respective side supports.

Figure 18A:
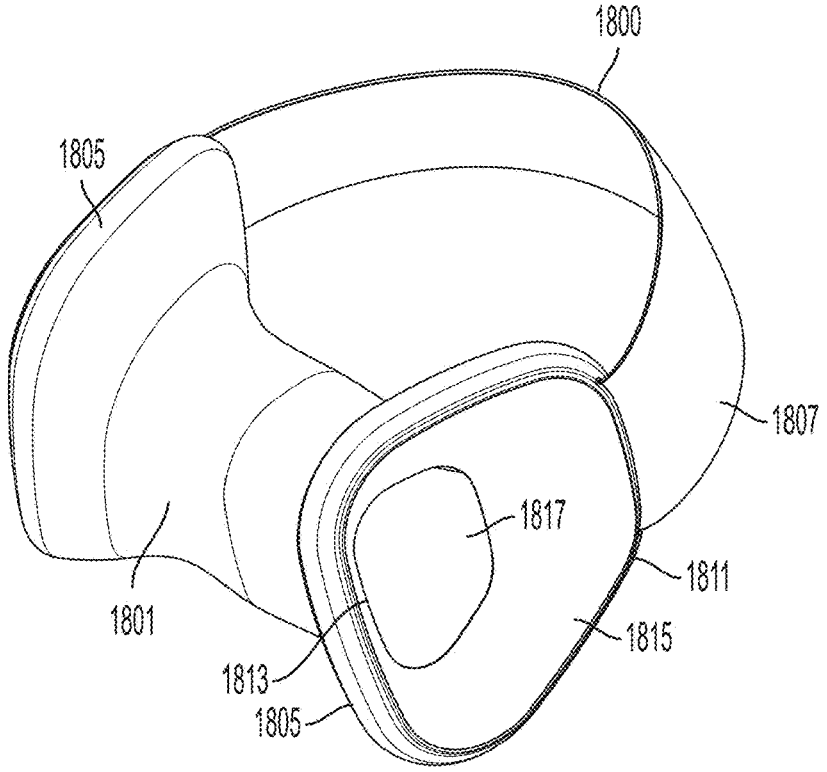
FIG. 18A is a first perspective view of an embodiment of the head support device in accordance with an aspect of the present disclosure.
Figure 18B:
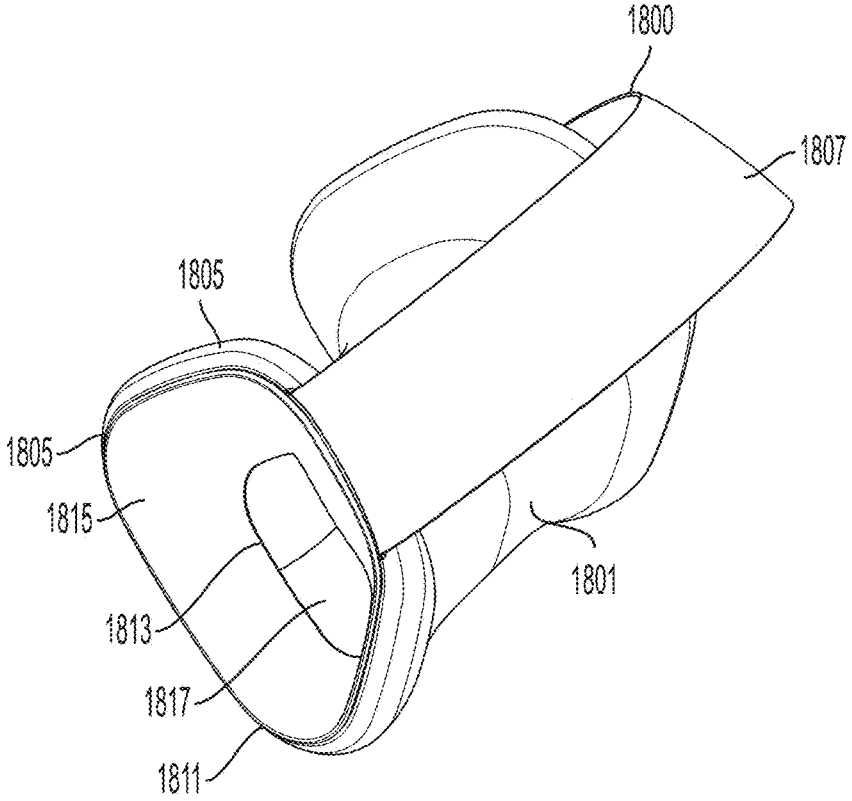
FIG. 18B is a second perspective view of the embodiment of the head support device illustrated in FIG. 18A.
Figure 18C:
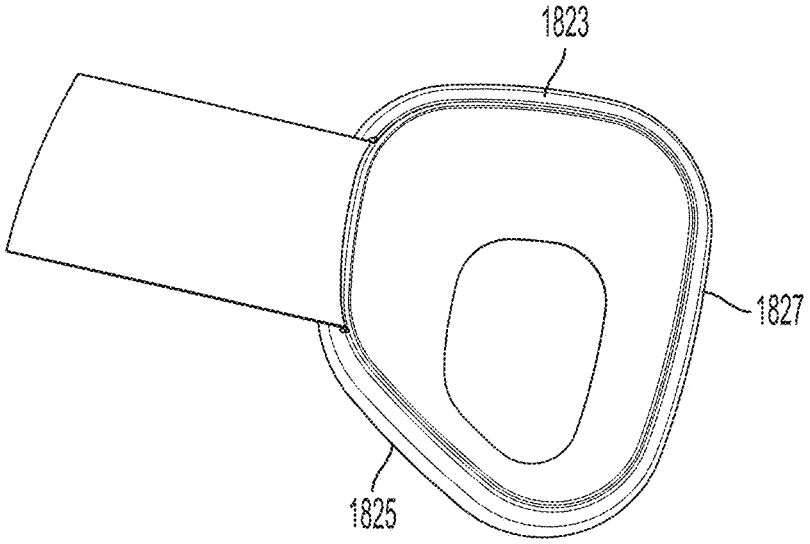
FIG. 18C is a side view of the embodiment of the head support device illustrated in FIGS. 18A-18B.
Figure 18D:
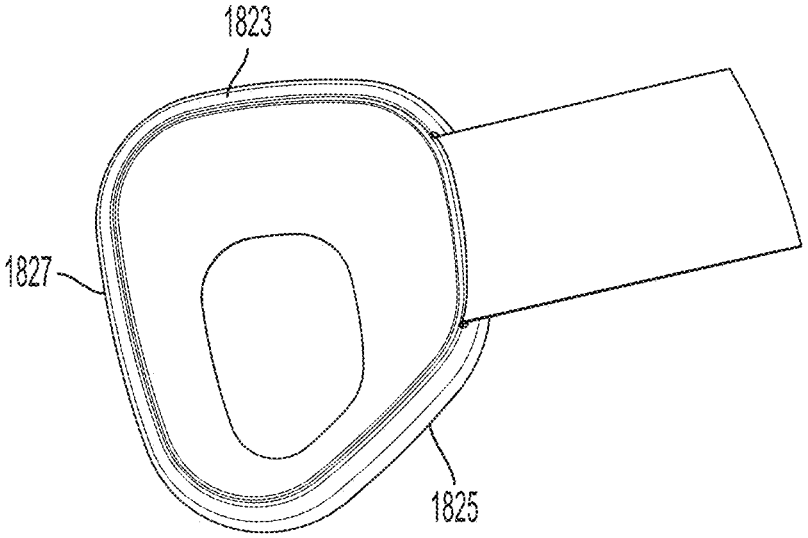
FIG. 18D is a second side view of the embodiment of the head support device illustrated in FIGS. 18A-18C.
Figure 18E:
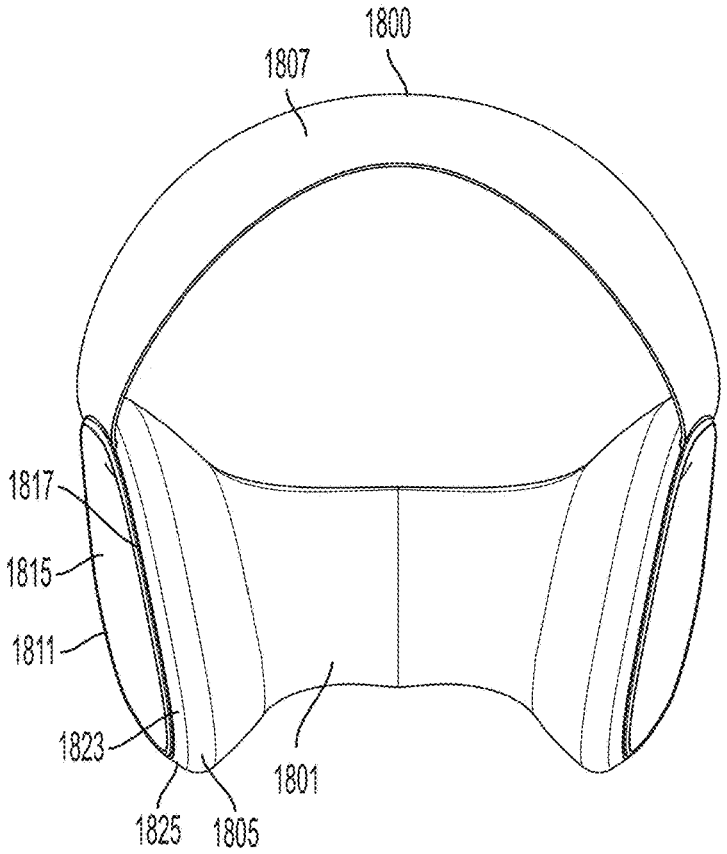
FIG. 18E is a top perspective view of the embodiment of the head support device illustrated in FIGS. 18A-18D.
Figure 18F:
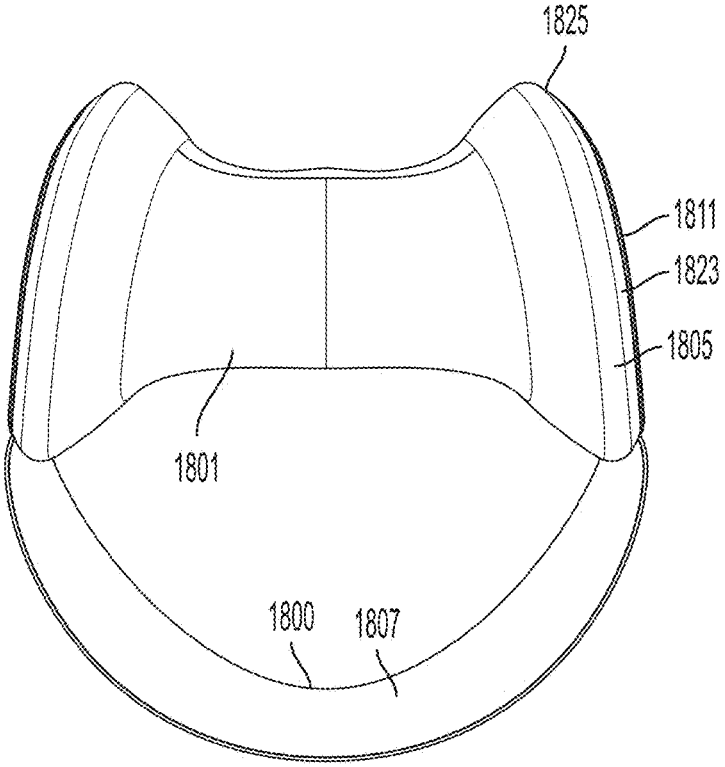
FIG. 18F is a bottom perspective view of the embodiment of the head support device illustrated in FIGS. 18A-18E.
Figure 18G:
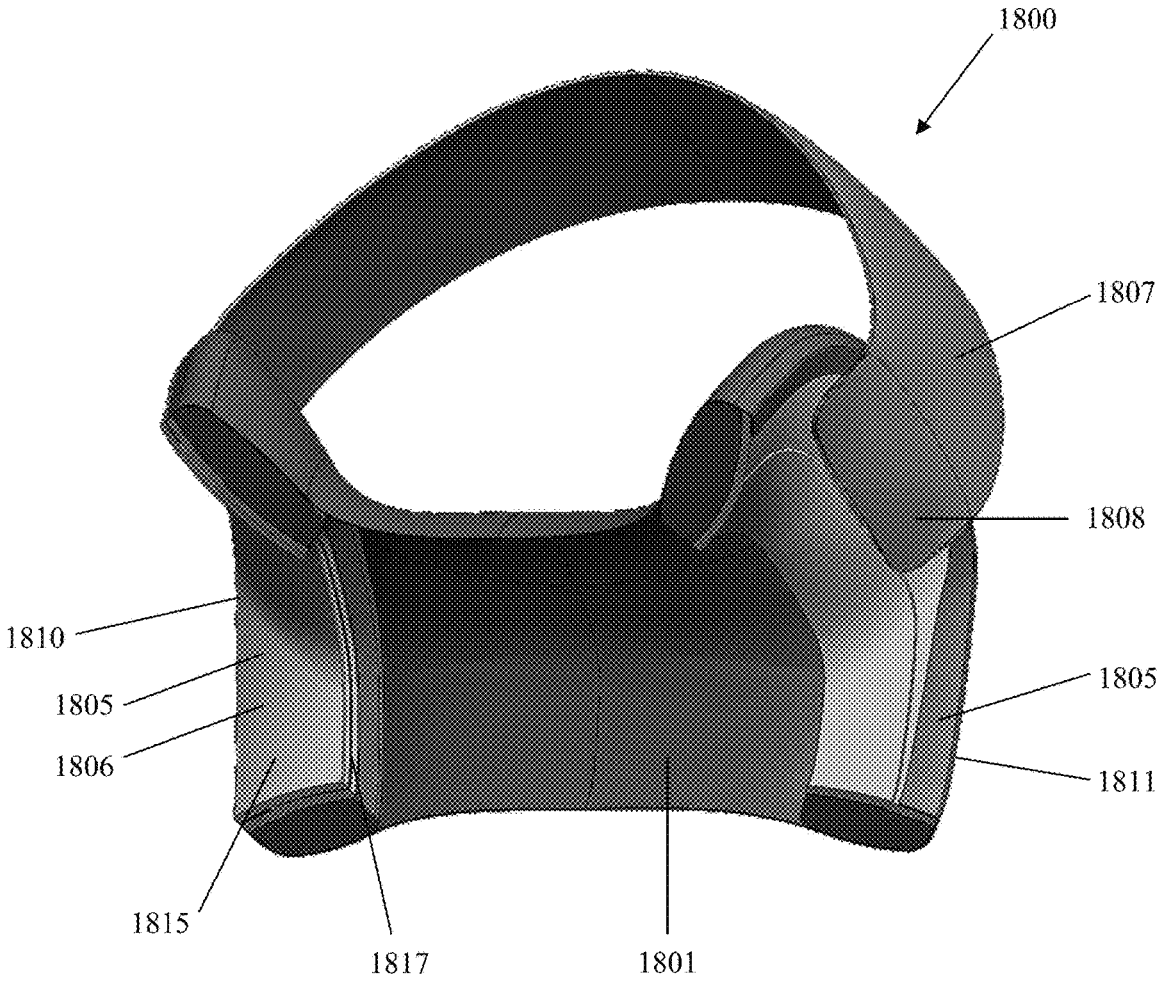
FIG. 18G is a cross-sectional view of the embodiment of the head support device illustrated in FIGS. 18A-18F.

FIG. 18A is a first perspective view of an embodiment of the head support device in accordance with an aspect of the present disclosure. FIG. 18B is a second perspective view of the embodiment of the head support device illustrated in FIG. 18A. FIG. 18C is a side view of the embodiment of the head support device illustrated in FIGS. 18A-18B. FIG. 18D is a second side view of the embodiment of the head support device illustrated in FIGS. 18A-18C. FIG. 18E is a top perspective view of the embodiment of the head support device illustrated in FIGS. 18A-18D. FIG. 18F is a bottom perspective view of the embodiment of the head support device illustrated in FIGS. 18A-18E. FIG. 18G is a cross-sectional view of the embodiment of the head support device illustrated in FIGS. 18A-18F.

In the embodiment illustrated in FIGS. 18A-18G, a head support device 1800 includes a central support 1801 configured to receive at least a portion of a user's chin. The central support 1801 may terminate into side supports 1805, each having a substantially trapezoidal cross-section. The two side supports 1805 may be connected by a connector element 1800. Each side support 1805 may have an outer perimeter 1811 and an inner perimeter 1813. The inner perimeter 1813 may be sized smaller than an outer perimeter 1811. The side support 1805 may include a surface 1815, sloped substantially inwards and spanning from the outer perimeter 1811 to the inner perimeter 1813. The side support 1805 having a trapezoidal cross-section, as illustrated at least in FIGS. 18C and 18D, may include a top side 1823 configured to extend substantially horizontally about a person's chin, a vertical side 1827, and a sloped side 1825 configured to engage with at least one of a user's neck and collarbone area.

In the embodiment illustrated in FIGS. 18A-18G, the memory foam portions of the padded regions such as the side supports 1805 and the central support 1801 may be covered in mesh. FIG. 18G provides a cross-sectional view of the head support device 1800. As illustrated in FIG. 18G, in some embodiments a mesh material may be positioned over a foam material. Further, a portion of a connector element may be secured to the side support by being placed under the mesh material and/or a plastic shell. As illustrated in some embodiments, a portion 1808 of the connector element 1807 may be configured to overlap with a part of the side support 1805 and be covered and secured in place by a plate 1806 configured to sit in the side support 1805. The connector element 1807, side supports 1805 and/or central support 1801 may be fit mechanically (e.g., protruding elements, snap fit) or via an adhesive. The plate 1806 may be adhesively or mechanically fit to the side support 1805. In some embodiments, the mesh material of the central support 1801 may be configured not to be flexible so as to provide sufficient support for a user's chin.

In the illustrated embodiment, elements of the head support device 1800 including portions of the side support 1805 may include foam covered with mesh. In the illustrated embodiment, elements of the head support device 1800 including the frame portion 1811, connector element 1807, and cover plate 1816 may include plastic such as neoprene and the like.

The embodiments illustrated in FIGS. 17A-18F may be modified to include various heights of the central support, as well as various shapes, sizes, and materials.

In an alternative embodiment, a head support device may include two side supports spaced apart and each configured to engage with a side of a user's chin. The two side supports may be connected by a connector element, however they may not include a central support. In such an embodiment, the head support device may be shaped like a sideways U.

It is understood that various attributes and elements from any one embodiment can also be included in other embodiments. Although the present disclosure has been described in detail with reference to certain preferred configurations thereof, other versions are possible. The actual scope of the disclosure encompasses not only the disclosed embodiments, but also all equivalent ways of practicing or implementing the disclosure. The above detailed description of the embodiments of the disclosure is not intended to be exhaustive or to limit the disclosure to the precise form disclosed above or to the particular field of usage mentioned in this disclosure. While specific embodiments of, and examples for, the disclosure are described above for illustrative purposes, various equivalent modifications are possible within the scope of the disclosure, as those skilled in the relevant art will recognize. The elements and acts of the various embodiments described above may be combined to provide further embodiments. Further, the teachings of the disclosure provided herein may be applied to products and systems other than head support devices.

The invention claimed is:

1. A head support device comprising:

a central support that runs between a first side support and a second side support, wherein the central support connects the first side support to the second side support, the central support configured to support a user's head and chin, the central support including a hollow interior, an upper surface configured to receive at least a portion of the user's chin, and a lower surface configured to face a user's chest, wherein the central support is breathable and includes at least one of a mesh and a screen; and a connector element having a first connector end configured to attach to the first side support at a first support end of the central support, and a second connector end configured to attach to the second side support at a second support end of the central support.

2. The head support device of claim 1, wherein each side support comprises a hollow interior configured to align with the hollow interior of the central support.

3. The head support device of claim 1, wherein each side support comprises a frame portion and a pad portion.

4. The head support device of claim 3, wherein the frame portion comprises a rigid material.

5. The head support device of claim 4, wherein the frame portion comprises plastic.

6. The head support device of claim 3, wherein the pad portion comprises at least one of polyurethane padding, and memory foam material.

7. The head support device of claim 1, wherein the connector element comprises a strap.

8. The head support device of claim 7, wherein the strap comprises at least one of an adjustable operable length and one or more portions detachable from one another.

9. The head support device of claim 1, wherein the central support is at least one of flexible and collapsible.

10. The head support device of claim 1, wherein each side support comprises a trapezoidal side cross-section.

11. The head support device of claim 1, wherein each side support has a vertical cross-section that is substantially outwardly C-shaped.

12. The head support device of claim 1, wherein each side support comprises a concave shape from the outside thereof.

13. The head support device of claim 1, wherein each side support comprises an inner perimeter and an outer perimeter, and having a sloped surface therebetween.

14. The head support device of claim 1, wherein at least one of a bottom surface of the central support, and the side supports is configured to engage with at least a portion of at least one of a user's chest, neck, shoulder, and collarbone.

15. The head support device of claim 1, wherein the first support end and the second support end of the central support each comprises a retaining member configured to secure the central support to the respective side support.

16. The head support device of claim 1, wherein the first support end and the second support end of the central support each comprises a collar for attachment to the side support.

17. The head support device of claim 1, wherein the respective ends of the connector element attaches to a frame portion of the respective side supports.

* * * * *